US012767310B2

(12) United States Patent
Vachon et al.

(10) Patent No.: US 12,767,310 B2
(45) Date of Patent: Oct. 20, 2026

(54) CRUISE CONTROL SYSTEM AND METHOD FOR A WATERCRAFT

(71) Applicant: BOMBARDIER RECREATIONAL PRODUCTS INC., Valcourt (CA)

(72) Inventors: Frederic Vachon, Granby (CA); Arshdeep Singh Multani, Sherbrooke (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 846 days.

(21) Appl. No.: 18/162,019

(22) Filed: Jan. 31, 2023

(65) Prior Publication Data

US 2023/0242233 A1 Aug. 3, 2023

Related U.S. Application Data

(60) Provisional application No. 63/304,949, filed on Jan. 31, 2022.

(51) Int. Cl.

| | |
|---|---|
| ***B63H 21/21*** | (2006.01) |
| ***B63B 3/48*** | (2006.01) |
| ***B63H 21/17*** | (2006.01) |

(52) U.S. Cl.

CPC ..... *B63H 21/213* (2013.01); *B63B 3/48* (2013.01); *B63H 21/17* (2013.01); *B63H 2021/216* (2013.01)

(58) Field of Classification Search

CPC ..... B63H 21/213; B63H 2021/216; B63H 21/21; B63B 3/48

See application file for complete search history.

(56) References Cited

U.S. PATENT DOCUMENTS

| | | | |
|---|---|---|---|
| 6,533,623 | B2 | 3/2003 | Simard et al. |
| 9,376,189 | B1 | 6/2016 | De Henau et al. |
| 9,908,601 | B2 | 3/2018 | Vachon |
| 10,864,972 | B2 | 12/2020 | Vachon et al. |
| 11,420,715 | B1 | 8/2022 | Simard et al. |
| 11,459,064 | B1 | 10/2022 | Simard et al. |

(Continued)

OTHER PUBLICATIONS

Can-Am Spyder® RT™ Series, Can-Am Spyder On-Road Vehicle 2020, includes Safety, Vehicle and Maintenance Information, Operator's Guide, © 2019 Bombardier Recreational Products Inc. and BRP US Inc.

*Primary Examiner* — Andrew Polay
(74) *Attorney, Agent, or Firm* — BCF LLP

(57) ABSTRACT

A watercraft comprises a hull, a deck disposed on the hull, a motor connected to at least one of the hull and the deck, a propulsion system operatively connected to the motor, a command console disposed on the deck and operatively connected to the motor, an accelerator control lever operatively connected to the command console, and a control unit operatively connected to the command console and to the motor. The control unit receives, from the command console, a value representing a current position of the accelerator control lever, controls an operating parameter of the motor based at least in part on the current position of the accelerator control lever, receives, from the command console, a cruise control enabling signal, and in response to receiving the cruise control enabling signal, selectively engages a cruise control function of the watercraft by maintaining the operating parameter of the motor.

20 Claims, 20 Drawing Sheets

(56) References Cited

U.S. PATENT DOCUMENTS

| | | | | |
|---|---|---|---|---|
| 11,634,195 | B1 | 4/2023 | Dupuis et al. | |
| 11,685,484 | B1 | 6/2023 | Hardy-Pare et al. | |
| 2005/0273224 | A1* | 12/2005 | Ito | B63H 21/22 701/93 |
| 2007/0293103 | A1* | 12/2007 | Kinoshita | F02D 11/02 440/1 |
| 2021/0294329 | A1* | 9/2021 | Afman | G08G 3/00 |

* cited by examiner

CRUISE CONTROL SYSTEM AND METHOD FOR A WATERCRAFT

CROSS-REFERENCE

The present application claims priority to U.S. Provisional Patent Application Ser. No. 63/304,949, filed on Jan. 31, 2022, the disclosure of which is incorporated herein by reference in its entirety.

FIELD OF TECHNOLOGY

The present technology relates to a cruise control system and method for a watercraft.

BACKGROUND

Cruise control is a common feature in many vehicles. On many road vehicles, cruise control systems are designed to maintain a selected ground speed of the vehicle. On other vehicles such as on a watercraft, in which a determination of a current vehicle speed is more complex, a cruise control system may be designed to maintain a selected input parameter of motor, such as an internal combustion engine or an electric motor of the watercraft, for example, a selected throttle control position, or a position or state of an equivalent accelerator control in cases where the watercraft is propelled using an electric motor.

Some personal watercraft have a spring loaded throttle lever (or accelerator control lever) mounted on a handlebar. The cruise control function may comprise a speed limiter that allows the driver to hold the throttle lever in a fully depressed position (100% throttle request) while the engine or motor is controlled at a lower throttle level selected by the driver. To this end the driver first achieves a desired watercraft speed by depressing the throttle lever to a desired position, for example at 50% throttle. The driver then activates the cruise control function by pressing a button (or engaging some other command input), which sets a throttle request limit in the vehicle's control unit. With this throttle limit set, any throttle request above that limit, 51%-100% in the above example, is communicated to the engine or motor as 50%. As such, the driver can now fully depress the throttle lever, as this is a more comfortable and less tiring position for the hand than having to keep the lever at the desired position (50% in the above example) on long rides. Using such cruise control system may allow maintaining the desired watercraft speed.

In contrast, the helm control of some recreational vessels, such as pontoon boats, comprises a steering wheel and a throttle/shift lever that is not spring loaded. These throttle/shift levers may be placed in a selected position across a range of forward, neutral and reverse throttle positions, following which they remain in that selected position (and thereby maintain a constant, selected engine or motor speed) even when let go of by the driver.

Some other watercraft are provided with handlebar steering systems similar to those typically found on personal watercrafts. In these watercraft, a finger-actuated throttle lever (or accelerator control lever) is mounted on the handlebar. In normal operation, the driver selects a changeable position of the throttle lever according to changes in a desired speed or acceleration of the vessel. For cruise control operation using the above-described techniques, after having selected a desired throttle position (e.g. 50%), the driver would need to continuously maintain the throttle at a fixed position (100%). This would be inconvenient in a boating context. As such, conventional cruise control solutions used in watercraft and in other vehicles are not readily adaptable for use in some handlebar-equipped watercraft.

In view of the foregoing, there is a need for a cruise control system and method for a watercraft that addresses at least some of these drawbacks.

SUMMARY

It is an object of the present technology to ameliorate at least some of the inconveniences present in the prior art.

According to a first aspect of the present technology, there is provided a method for controlling a cruising speed of a watercraft, the watercraft having a hull, a deck disposed on the hull, a motor connected to at least one of the hull and the deck, a propulsion system operatively connected to the motor, a command console disposed on the deck and operatively connected to the motor, and an accelerator control lever operatively connected to the command console, the accelerator control lever being biased toward an idle position, the method comprising: receiving, in a control unit from the command console, a value representing a position of the accelerator control lever; controlling, by the control unit, an operating parameter of the motor, the operating parameter being determined based at least in part on the position of the accelerator control lever; receiving, in the control unit, a cruise control enabling signal from the command console; in response to receiving the cruise control enabling signal, selectively engaging a cruise control function of the watercraft by maintaining, by the control unit, the operating parameter of the motor to a value current when the cruise control enabling signal is received; receiving, in the control unit, a signal indicating a new activation of the accelerator control lever; and in response to receiving the signal indicating the new activation of the accelerator control lever while the cruise control function is engaged, selectively disengaging, by the control unit, the cruise control function of the watercraft.

According to a second aspect of the present technology, there is provided a method for controlling a cruising speed of a watercraft, the watercraft having a hull, a deck disposed on the hull, a motor connected to at least one of the hull and the deck, a propulsion system operatively connected to the motor, a command console disposed on the deck and operatively connected to the motor, and an accelerator control lever operatively connected to the command console, the accelerator control lever being biased toward an idle position, the method comprising: receiving, in a control unit from the command console, a value representing a position of the accelerator control lever; controlling, by the control unit, an operating parameter of the motor, the operating parameter being determined based at least in part on the position of the accelerator control lever; receiving, in the control unit, a cruise control enabling signal from the command console; in response to receiving the cruise control enabling signal, selectively engaging a cruise control function of the watercraft by maintaining, by the control unit, the operating parameter of the motor to a value current when the cruise control enabling signal is received; initiating a timing function, by the control unit, in response to receiving the cruise control enabling signal; detecting an expiry of the timing function; in response to detecting the expiry of the timing function, determining a new position of the accelerator control lever; and in response to the new position of the accelerator control lever indicating that the accelerator control lever has not been released, selectively disengaging the cruise control function of the watercraft.

In some embodiments of the present technology, the propulsion system is a jet propulsion system.

In some embodiments of the present technology, the jet propulsion system comprises a reverse gate having a forward position and a reverse position; and engaging the cruise control function of the watercraft is conditional to the reverse gate being in the forward position before receiving the cruise control enabling signal at the control unit.

In some embodiments of the present technology, the jet propulsion system comprises a reverse gate having a range of forward positions and a range of reverse positions; the reverse gate, the motor and the control unit implement a braking function configured for placing the reverse gate in a reverse position and for increasing a thrust generated by the propulsion system in response to receiving, in the control unit, a signal activating the braking function; and the method further comprises disengaging the cruise control function of the watercraft in response to receiving, in the control unit, the signal activating the braking function.

In some embodiments of the present technology, engaging the cruise control function of the watercraft is conditional to the motor running when receiving the cruise control enabling signal at the control unit.

In some embodiments of the present technology, the watercraft further comprises a forward operation mode and a reverse operation mode; and engaging the cruise control function of the watercraft is conditional to the forward operation mode being engaged when receiving the cruise control enabling signal at the control unit.

In some embodiments of the present technology, the method further comprises disengaging the cruise control function of the watercraft in response to receiving a deceleration signal in the control unit.

In some embodiments of the present technology, the method further comprises disengaging the cruise control function of the watercraft in response to receiving a cruise control disabling signal in the control unit.

In some embodiments of the present technology, the command console comprises a handlebar assembly, the accelerator control lever being mounted to the handlebar assembly.

In some embodiments of the present technology, the accelerator control lever is a finger-actuated control lever.

In some embodiments of the present technology, the cruise control enabling signal is generated by actuating a cruise control button mounted on the handlebar assembly.

In some embodiments of the present technology, the method further comprises causing, by the control unit, a display device to display an error message in response to any condition preventing the selective engagement of the cruise control function.

In some embodiments of the present technology, the method further comprises causing, by the control unit, a display device to display an icon when the cruise control function is engaged.

In some embodiments of the present technology, the method further comprises causing, by the control unit, a display device to display a temporary message at repeated intervals when the cruise control function is engaged.

In some embodiments of the present technology, the watercraft is a pontoon.

In some embodiments of the present technology, the method further comprises receiving an increase or a decrease signal from the command console at the control unit; and selectively increasing or decreasing a set-point of the cruise control function in response to receiving the increase or decrease signal, respectively.

In some embodiments of the present technology, the method further comprises disengaging the cruise control function of the watercraft in response to receiving, in the control unit, an indication that that the accelerator control lever is at a position that exceeds a deactivating threshold.

In some embodiments of the present technology, the method further comprises ramping up or down the operating parameter of the motor between a first set-point effective before disengaging the cruise control function and a second set-point determined according to a position of the accelerator control lever following the disengagement of the cruise control function.

In some embodiments of the present technology, the method further comprises receiving, in the control unit, a cruise control disabling signal; and in response to receiving the cruise control disabling signal, gradually decreasing the operating parameter of the motor.

In some embodiments of the present technology, the timing function expires 1 to 5 seconds after being initiated.

In some embodiments of the present technology, the operating parameter of the motor is a rotational speed of a component of the motor.

In some embodiments of the present technology, the operating parameter of the motor is an output torque of the motor.

In some embodiments of the present technology, the motor is an internal combustion engine; and the operating parameter of the motor is a throttle opening of the internal combustion engine.

According to a third aspect of the present technology, there is provided a watercraft, comprising: a hull; a deck disposed on the hull; a motor connected to at least one of the hull and the deck; a propulsion system operatively connected to the motor; a command console disposed on the deck and operatively connected to the motor; an accelerator control lever operatively connected to the command console, the accelerator control lever being biased toward an idle position; a control unit operatively connected to the command console and to the motor, the control unit being configured to: receive, from the command console, a value representing a position of the accelerator control lever; control an operating parameter of the motor, the operating parameter being determined based at least in part on the position of the accelerator control lever; receive, from the command console, a cruise control enabling signal; in response to receiving the cruise control enabling signal, selectively engage a cruise control function of the watercraft by maintaining the operating parameter of the motor to a value current when the cruise control enabling signal is received; receive a signal indicating a new activation of the accelerator control lever; and in response to receiving the signal indicating the new activation of the accelerator control lever while the cruise control function is engaged, selectively disengage the cruise control function of the watercraft.

According to a fourth aspect of the present technology, there is provided a watercraft, comprising: a hull; a deck disposed on the hull; a motor connected to at least one of the hull and the deck; a propulsion system operatively connected to the motor; a command console disposed on the deck and operatively connected to the motor; an accelerator control lever operatively connected to the command console, the accelerator control lever being biased toward an idle position; a control unit operatively connected to the command console and to the motor, the control unit being configured to: receive, from the command console, a value representing a position of the accelerator control lever;

control an operating parameter of the motor, the operating parameter being determined based at least in part on the position of the accelerator control lever; receive, from the command console, a cruise control enabling signal; in response to receiving the cruise control enabling signal, selectively engage a cruise control function of the watercraft by maintaining the operating parameter of the motor to a value current when the cruise control enabling signal is received; initiate a timing function in response to receiving the cruise control enabling signal; detect an expiry of the timing function; in response to detecting the expiry of the timing function, determining a new position of the accelerator control lever; and in response to the new position of the accelerator control lever indicating that the accelerator control lever has not been released, selectively disengage the cruise control function of the watercraft.

In some embodiments of the present technology, the propulsion system is a jet propulsion system.

In some embodiments of the present technology, the jet propulsion system comprises a reverse gate having a forward position and a reverse position; and the control unit is further configured to conditionally cause to engage the cruise control function of the watercraft in response to the reverse gate being in the forward position before receiving the cruise control enabling signal.

In some embodiments of the present technology, the jet propulsion system comprises a reverse gate having a range of forward positions and a range of reverse positions; the reverse gate, the motor and the control unit implement a braking function in which the control unit is further configured for causing the reverse gate to be placed in a reverse position and for causing an increase of a thrust generated by the propulsion system in response to receiving a signal activating the braking function; and the control unit is further configured to disengage the cruise control function of the watercraft in response to receiving the signal activating the braking function.

In some embodiments of the present technology, the control unit is further configured to selectively engage the cruise control function of the watercraft in response to the motor running when receiving the cruise control enabling signal.

In some embodiments of the present technology, the watercraft further comprises a forward operation mode and a reverse operation mode; and the control unit is further configured to selectively engage the cruise control function of the watercraft in response to the forward operation mode being engaged when receiving the cruise control enabling signal.

In some embodiments of the present technology, the control unit is further configured to disengage the cruise control function of the watercraft in response to receiving a deceleration signal.

In some embodiments of the present technology, the control unit is further configured to disengage the cruise control function of the watercraft in response to receiving a cruise control disabling signal.

In some embodiments of the present technology, the command console comprises a handlebar assembly, the accelerator control lever being mounted to the handlebar assembly.

In some embodiments of the present technology, the accelerator control lever is a finger-actuated control lever.

In some embodiments of the present technology, the watercraft further comprises a cruise control button mounted on the handlebar assembly, the cruise control enabling signal being generated by the cruise control button when actuated.

In some embodiments of the present technology, the watercraft further comprises a display device, the control unit being further configured to cause the display device to display an error message in response to any condition preventing the selective engagement of the cruise control function.

In some embodiments of the present technology, the watercraft further comprises a display device, the control unit being further configured to cause the display device to display an icon when the cruise control function is engaged.

In some embodiments of the present technology, the watercraft further comprises a display device, the control unit being further configured to cause the display device to display a temporary message at repeated intervals when the cruise control function is engaged.

In some embodiments of the present technology, the watercraft is a pontoon.

In some embodiments of the present technology, the control unit is further configured to: receive an increase or a decrease signal from the command console; and selectively increase or decrease a set-point of the cruise control function in response to receiving the increase or decrease signal, respectively.

In some embodiments of the present technology, the control unit is further configured to disengage the cruise control function of the watercraft in response to receiving an indication that that the accelerator control lever is at a position that exceeds a deactivating threshold.

In some embodiments of the present technology, the control unit is further configured to ramp up or down the operating parameter of the motor between a first set-point effective before disengaging the cruise control function and a second set-point determined according to a position of the accelerator control lever following the disengagement of the cruise control function.

In some embodiments of the present technology, the control unit is further configured to: receive a cruise control disabling signal; and in response to receiving the cruise control disabling signal, gradually decrease the operating parameter of the motor.

In some embodiments of the present technology, the timing function expires 1 to 5 seconds after being initiated.

In some embodiments of the present technology, the operating parameter of the motor is a rotational speed of a component of the motor.

In some embodiments of the present technology, the operating parameter of the motor is an output torque of the motor.

In some embodiments of the present technology, the motor is an internal combustion engine; and the operating parameter of the motor is a throttle opening of the internal combustion engine.

In some embodiments of the present technology, the control unit comprises: a user input module operatively connected to the command console and configured to receive signals from the command console; and an engine control module operatively connected to the user input module and to the motor, the engine control module being configured to control operations of the motor.

In some embodiments of the present technology, the control unit comprises: a user input module operatively connected to the command console and configured to receive signals from the command console; an engine control module operatively connected to the user input module and to the motor, the engine control module being configured to control operations of the motor; and a reverse gate controller operatively connected to the user input module, to the engine control module and to the reverse gate, the reverse gate controller being configured to control movements of the reverse gate.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
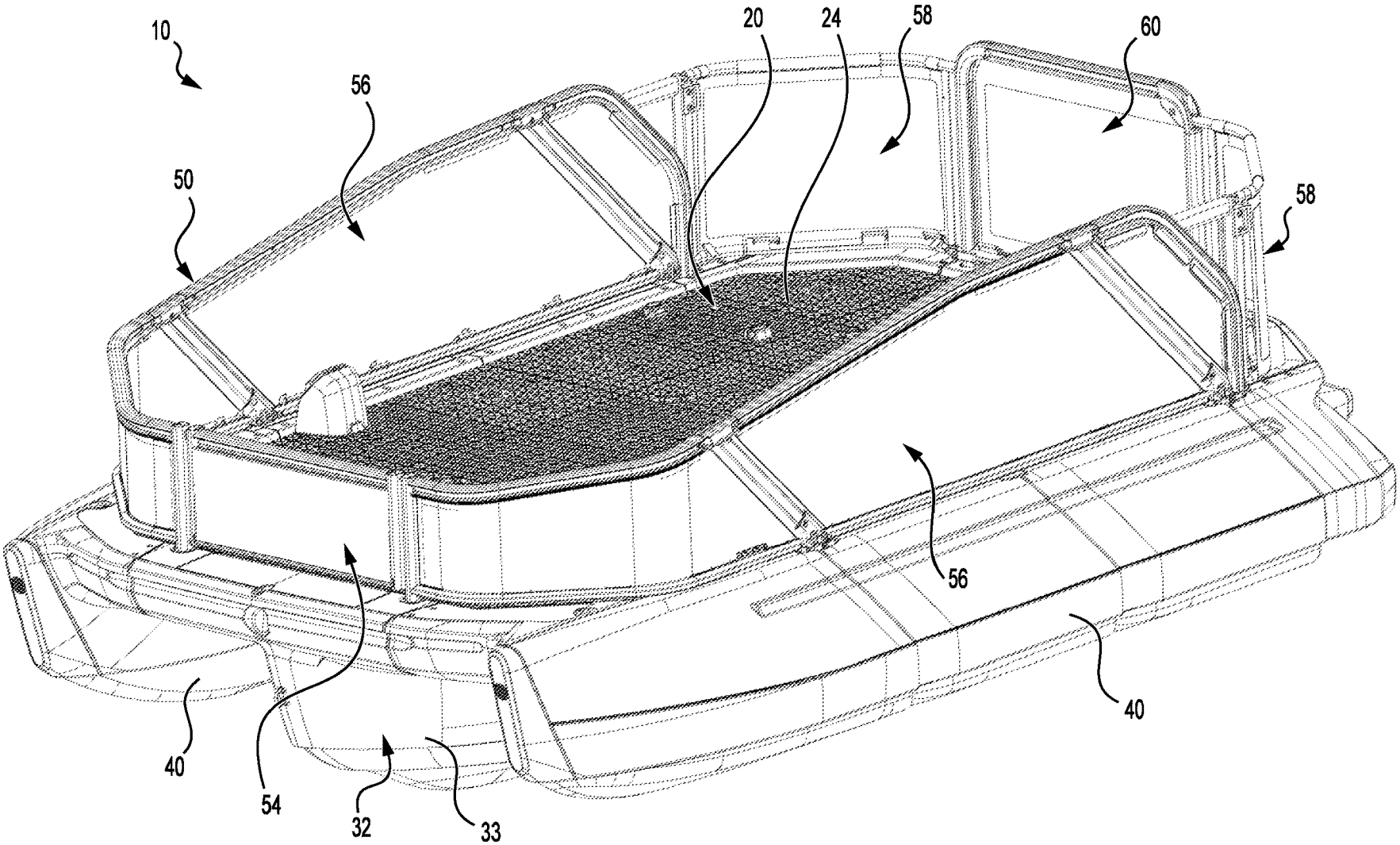
FIG. 1 is a perspective view, taken from a top, front, left side of a pontoon boat in accordance with an embodiment of the present technology.
Figure 2:
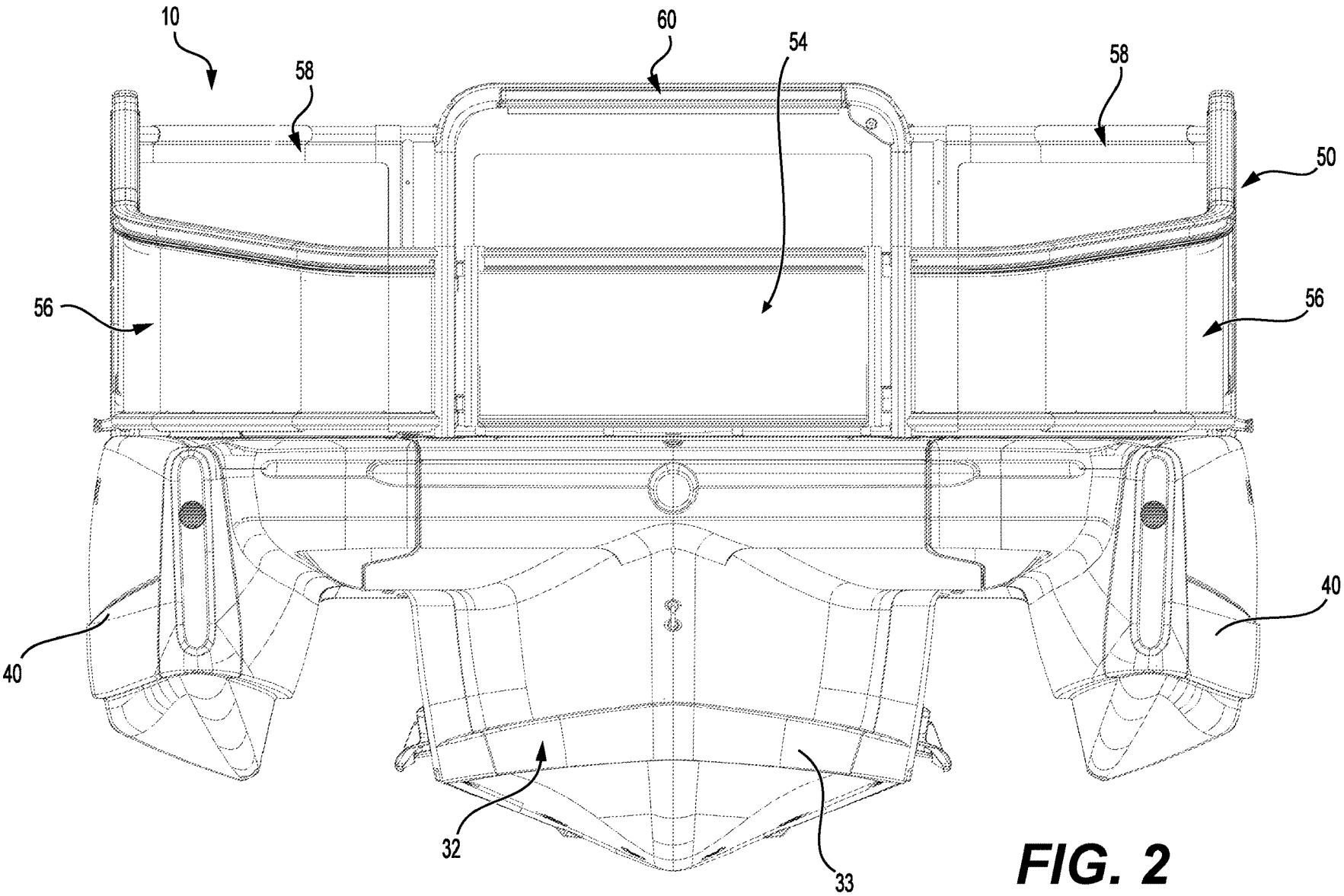
FIG. 2 is a front elevation view of the pontoon boat of FIG. 1.

For purposes of this application, terms related to spatial orientation such as forwardly, rearwardly, left, and right, are as they would normally be understood by a driver of the watercraft sitting thereon in a normal driving position.

A watercraft 10 in accordance with one embodiment of the present technology is shown in FIGS. 1 to 5. The following description relates to one example of a watercraft 10, notably a pontoon boat 10. Those of ordinary skill in the art will recognize that there are other known types of watercraft incorporating different designs and that at least some aspects of the present technology could be used with these other watercraft. The description of the various embodiments as applied to the pontoon boat 10 should therefore be considered as illustrative and not limiting.

The pontoon boat 10 has a deck 20 and a hull 32 supporting the deck 20. In this embodiment, the hull 32 includes three separate laterally-adjacent portions that are connected to one another to form the hull 32. Notably, the hull 32 has a central portion 33 and left and right lateral portions 40. These different hull portions could be considered separate hulls in some cases and thus the boat 10 may be referred to as a multihull watercraft in some cases. Nevertheless, it is contemplated that the hull 32 may have a single integral portion in other embodiments.

The deck 20 extends above the hull 32 and is supported thereby. The deck 20 has an upper surface 24 for supporting occupants, as well as accessories and accommodations of the boat 10 (e.g., seating, command console, etc.). In this embodiment, as best seen in FIG. 1, the deck 20 includes a plurality of tiles 22 which are configured for attachment of accessories thereto. The tiles 22 form a portion of the upper surface 24 of the deck 20. The command console (FIGS. 5 to 9) is not shown in FIGS. 1 to 4 in order to better show the upper surface 24 of the deck 20. In the shown embodiment, the upper surface 24 of the deck 20 is symmetric about a longitudinal centerplane CP (FIG. 4) of the boat 10.

It is contemplated that the deck 20 could have a different construction than that provided by the tiles 22. For instance, the deck 20 could have a more conventional construction such as including a metallic frame and an overlying flooring layer, such as wooden panels or plywood. It is further contemplated that the deck 20 could include multiple levels and/or seating or other accessories integrated therein.

The boat 10 is propelled by a jet propulsion system 52 (shown in part in FIGS. 3 and 5) powered by a motor 146, for example an internal combustion engine (ICE) or an electric motor (not shown). The jet propulsion system 52 has a steering nozzle 152 used for steering the boat 10. It is contemplated that other propulsion systems, such as a stern drive or a marine outboard ICE or electric motor, may be used to propel the boat 10. It is also contemplated that that the steering nozzle 152 could be replaced by an outdrive or one or more rudders.

Figure 3:
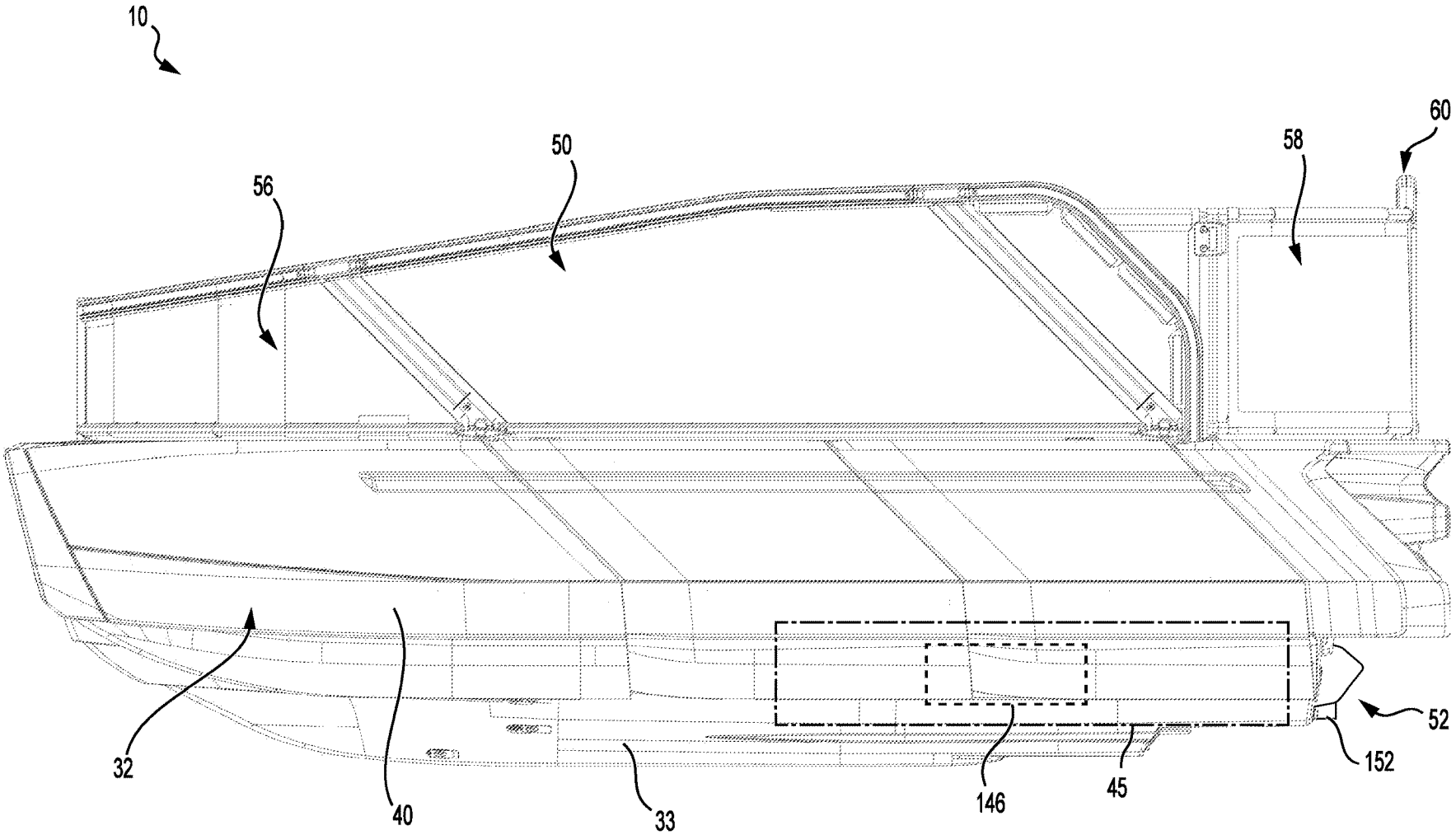
FIG. 3 is a left side elevation view of the pontoon boat of FIG. 1.
Figure 4:
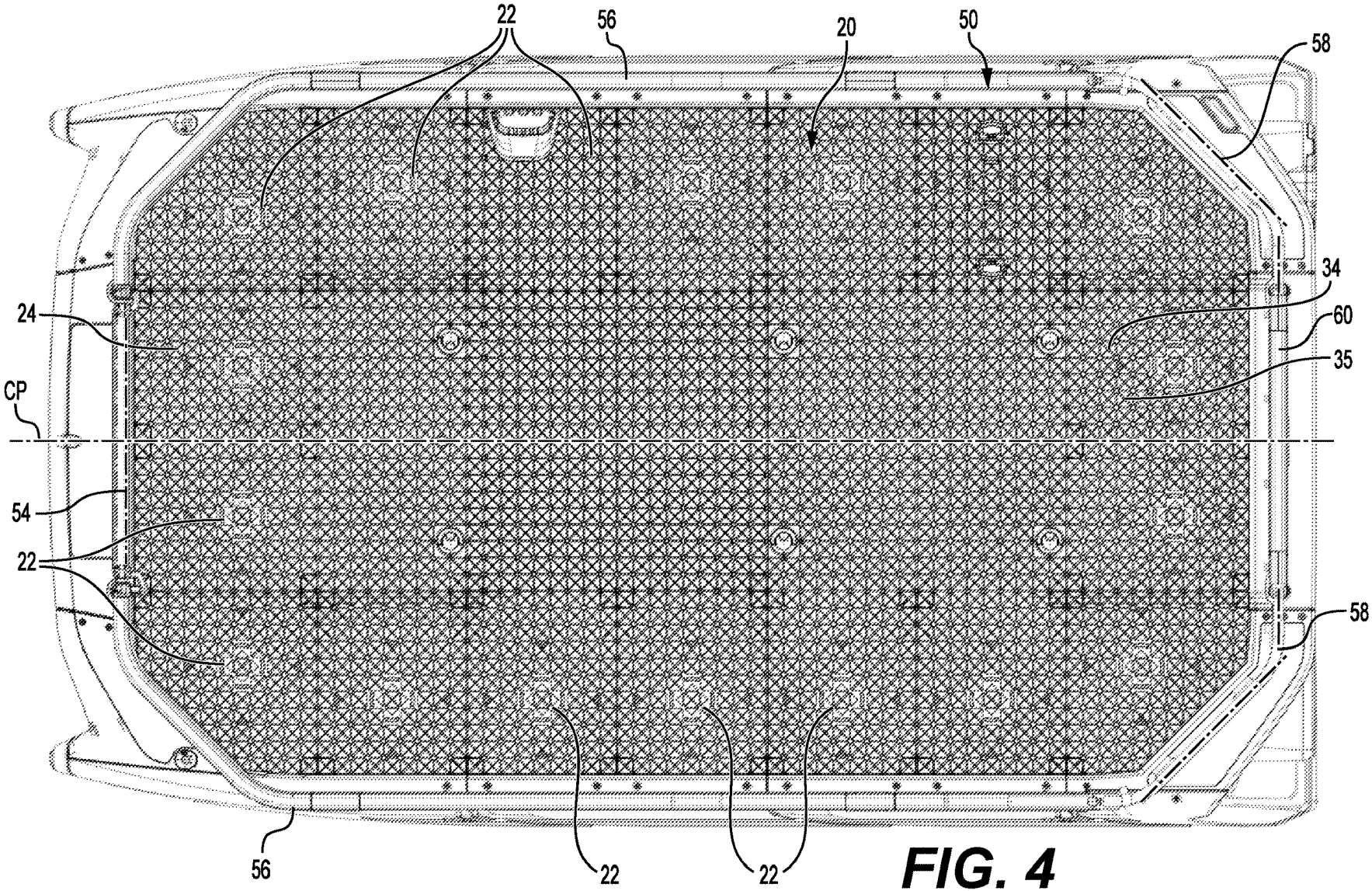
FIG. 4 is a top plan view of the pontoon boat of FIG. 1.

A powerpack 45 of the boat 10, including the jet propulsion system 52 and the motor 146, is enclosed in part by the hull 32 (the powerpack 45 and the motor 146 are both schematically illustrated in FIG. 3). As shown in FIG. 4, a central hull cover 34 overlies the powerpack 45 to partly enclose the powerpack 45 between the hull 32 and the hull cover 34. An upper surface 35 of the central hull cover 34 is contiguous with the upper surface 24 of the deck 20 (i.e., flush therewith). Although the jet propulsion system 52 is illustrated, it is contemplated that the boat 10 could have a propeller driven by the motor.

The boat 10 has a barrier structure 50 surrounding at least part of the deck 20 and extending upwardly therefrom. In particular, the barrier structure 50 is located along a periphery of the boat 10 (as defined by the deck 20) to prevent occupants or objects on the deck 20 from accidentally falling off the boat 10. As shown in FIGS. 1 to 4, in this embodiment, the barrier structure 50 generally surrounds the entirety of the deck 20. Notably, the barrier structure 50 includes a front end portion 54, left and right lateral portions 56, left and right rear corner portions 58, and a rear end portion 60. It is contemplated that, in other embodiments, the barrier structure 50 could only partially surround the deck 20. For example, one or more of the portions 54, 56, 58, 60 could be omitted.

Figure 5:
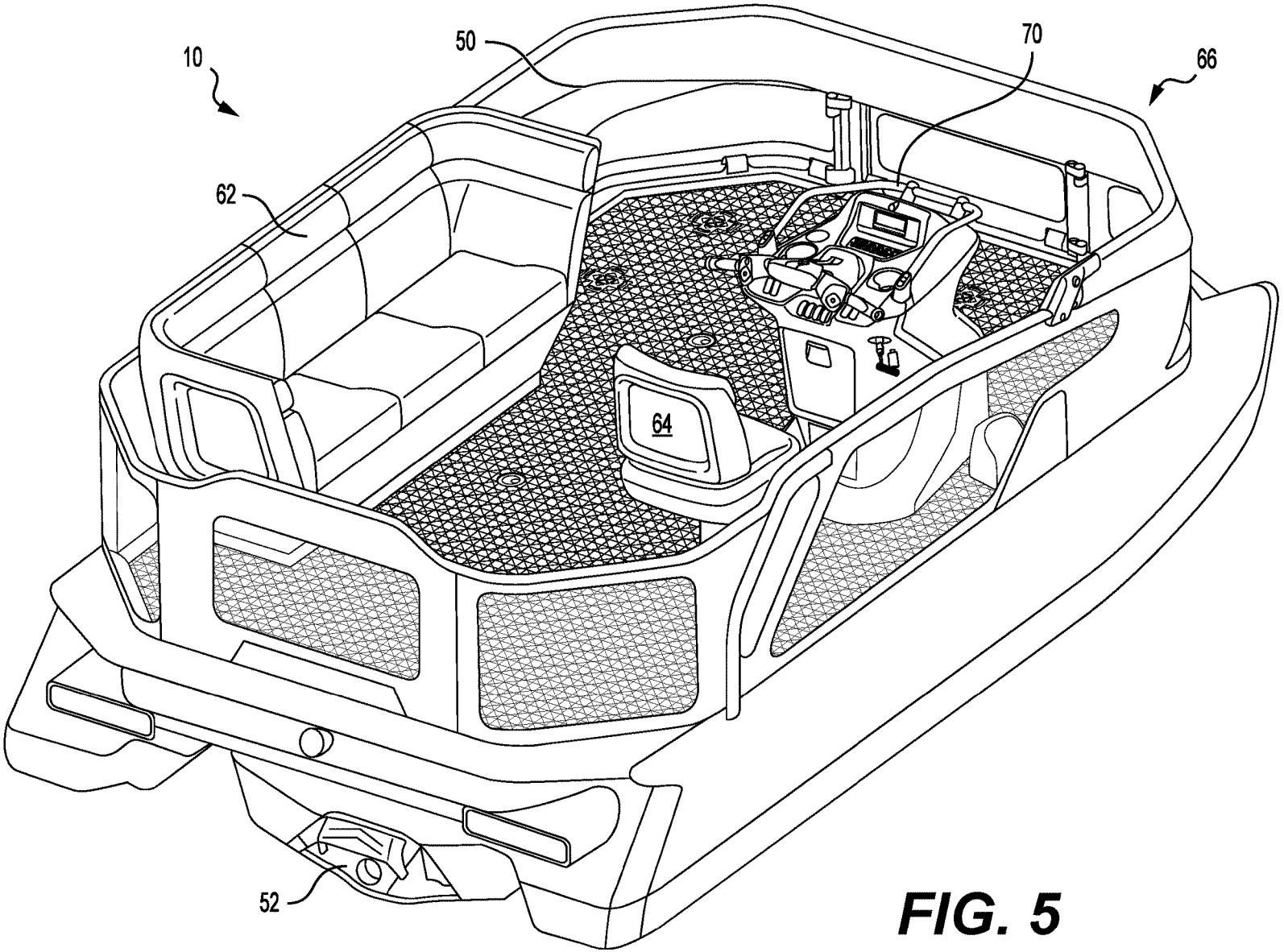
FIG. 5 is a perspective view, taken from a top, rear, right side of the pontoon boat of FIG. 1, a bench, a driver seat and a command console being mounted on the deck of the pontoon boat in accordance with an embodiment of the present technology.
Figure 6:
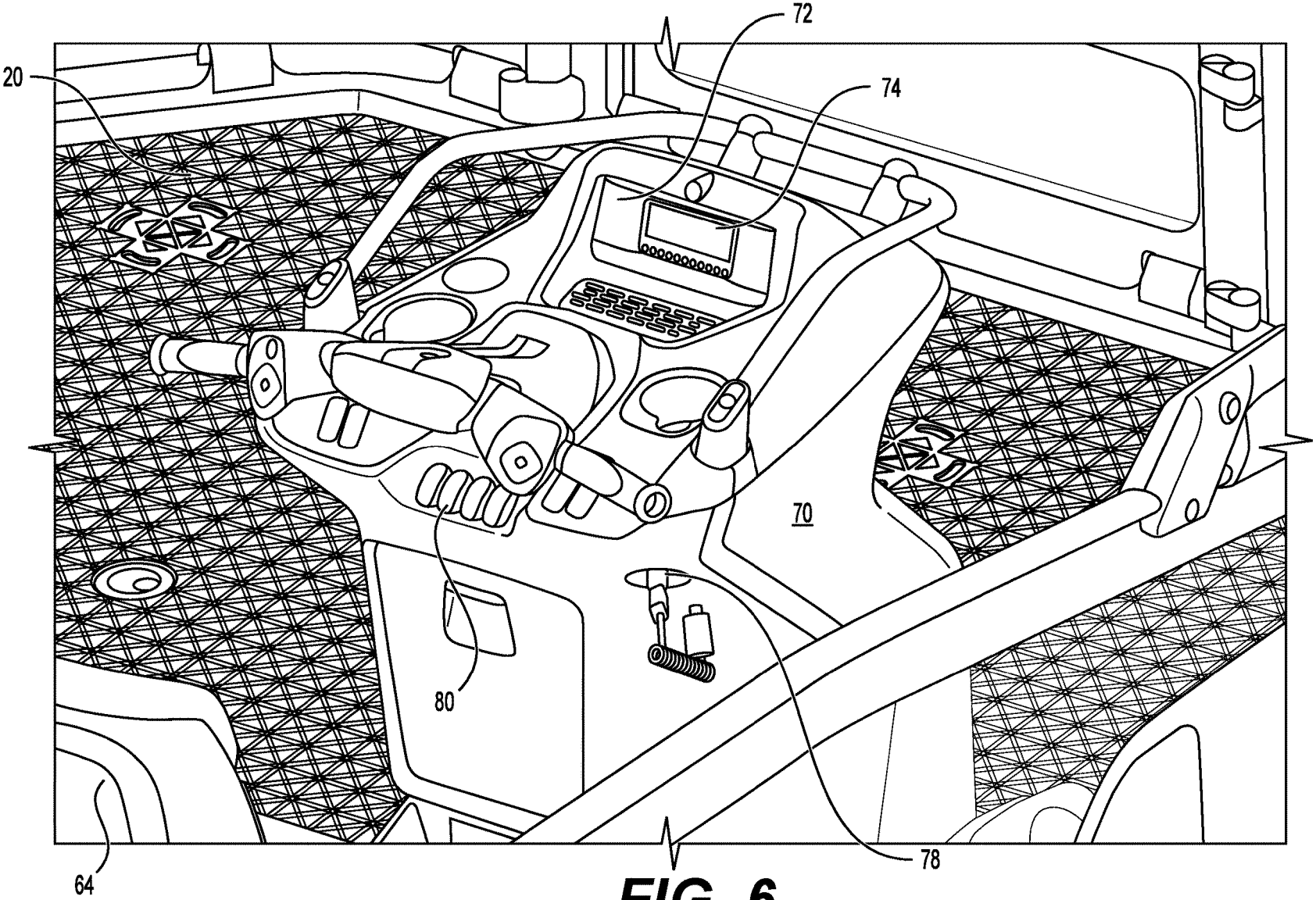
FIG. 6 is a close up, perspective view of the command console of FIG. 5.
Figure 7:
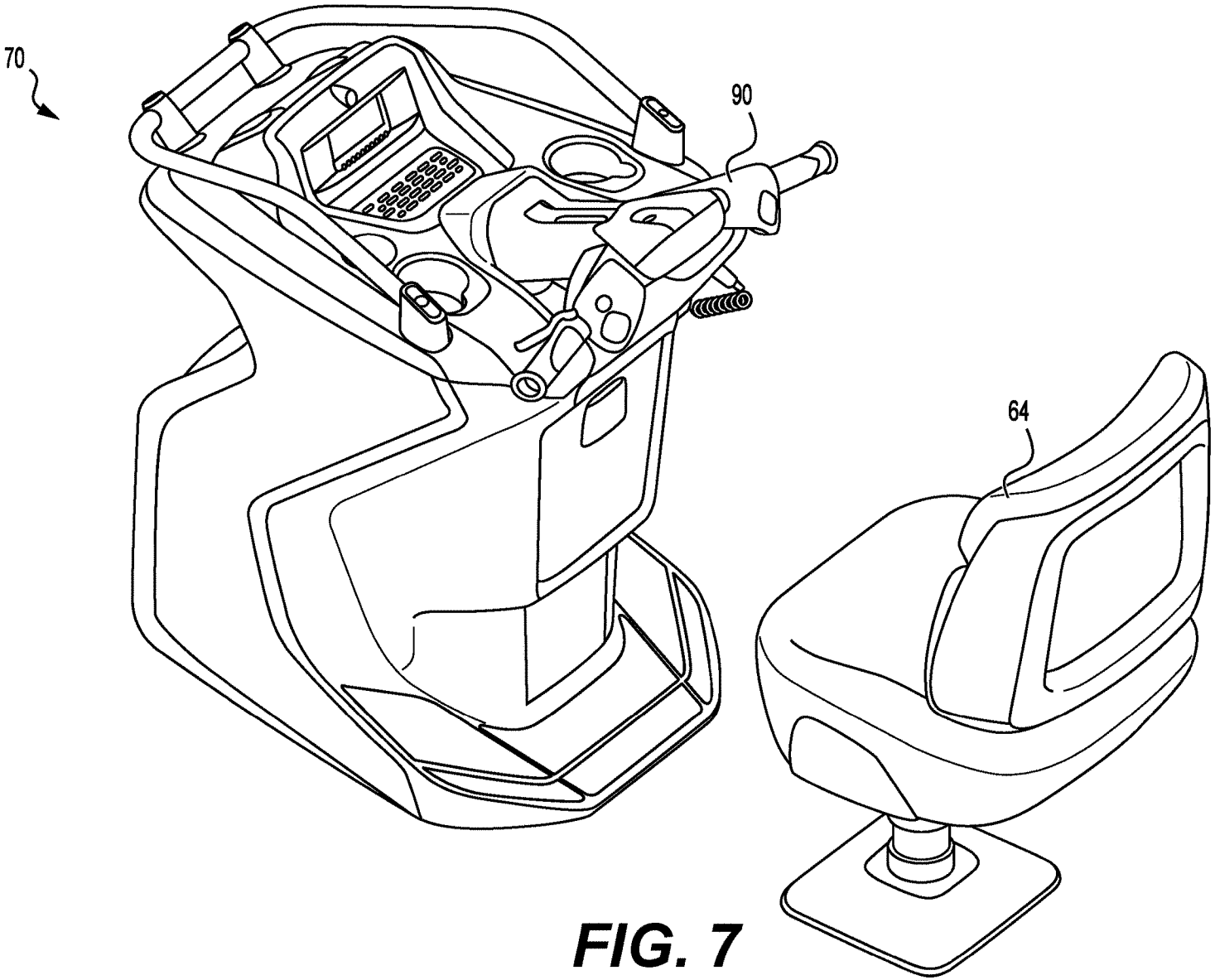
FIG. 7 is a perspective view, taken from a top, rear, left side of the driver seat and command console of FIG. 5.
Figure 8:
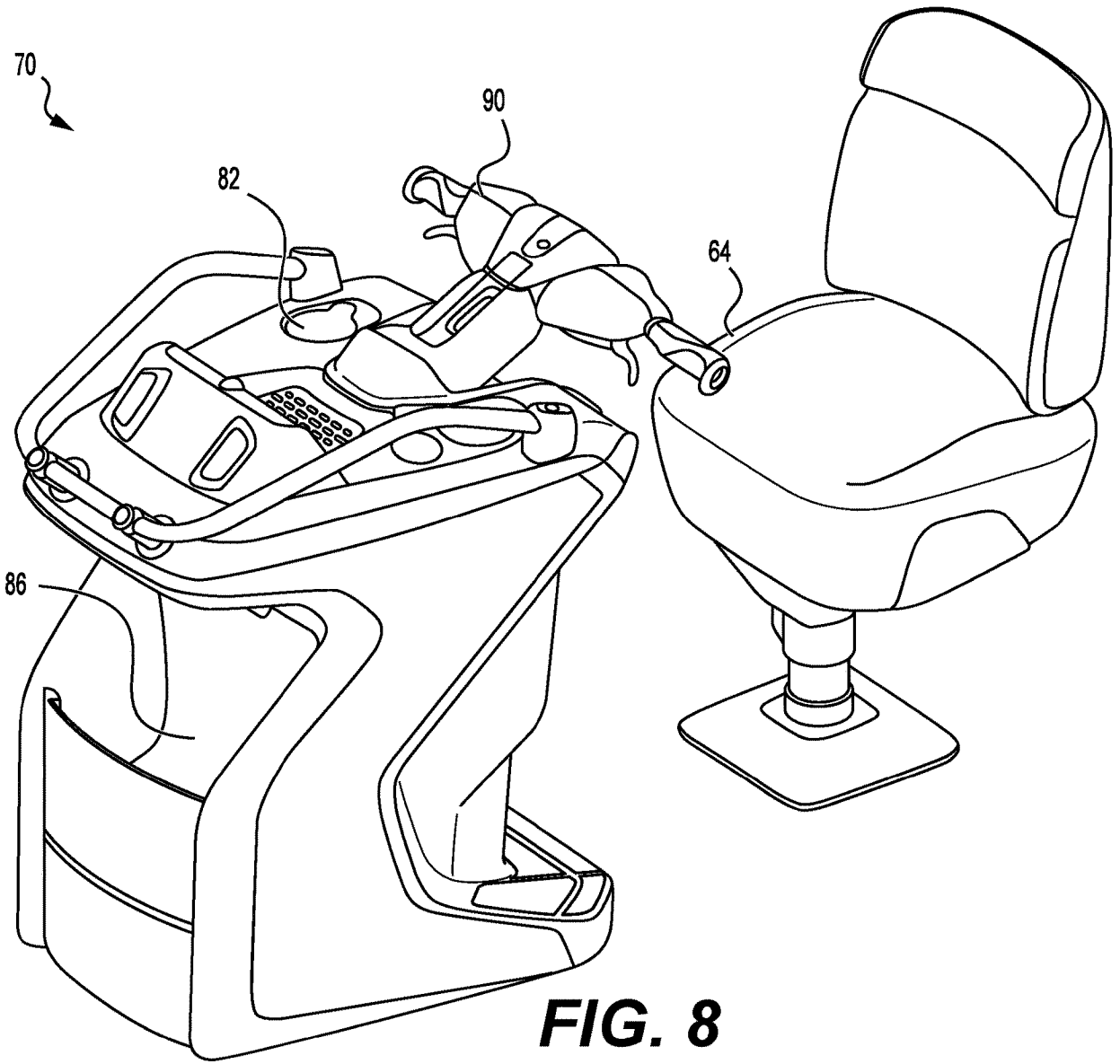
FIG. 8 is a perspective view, taken from a top front, left side of the driver seat and command console of FIG. 5.
Figure 9:
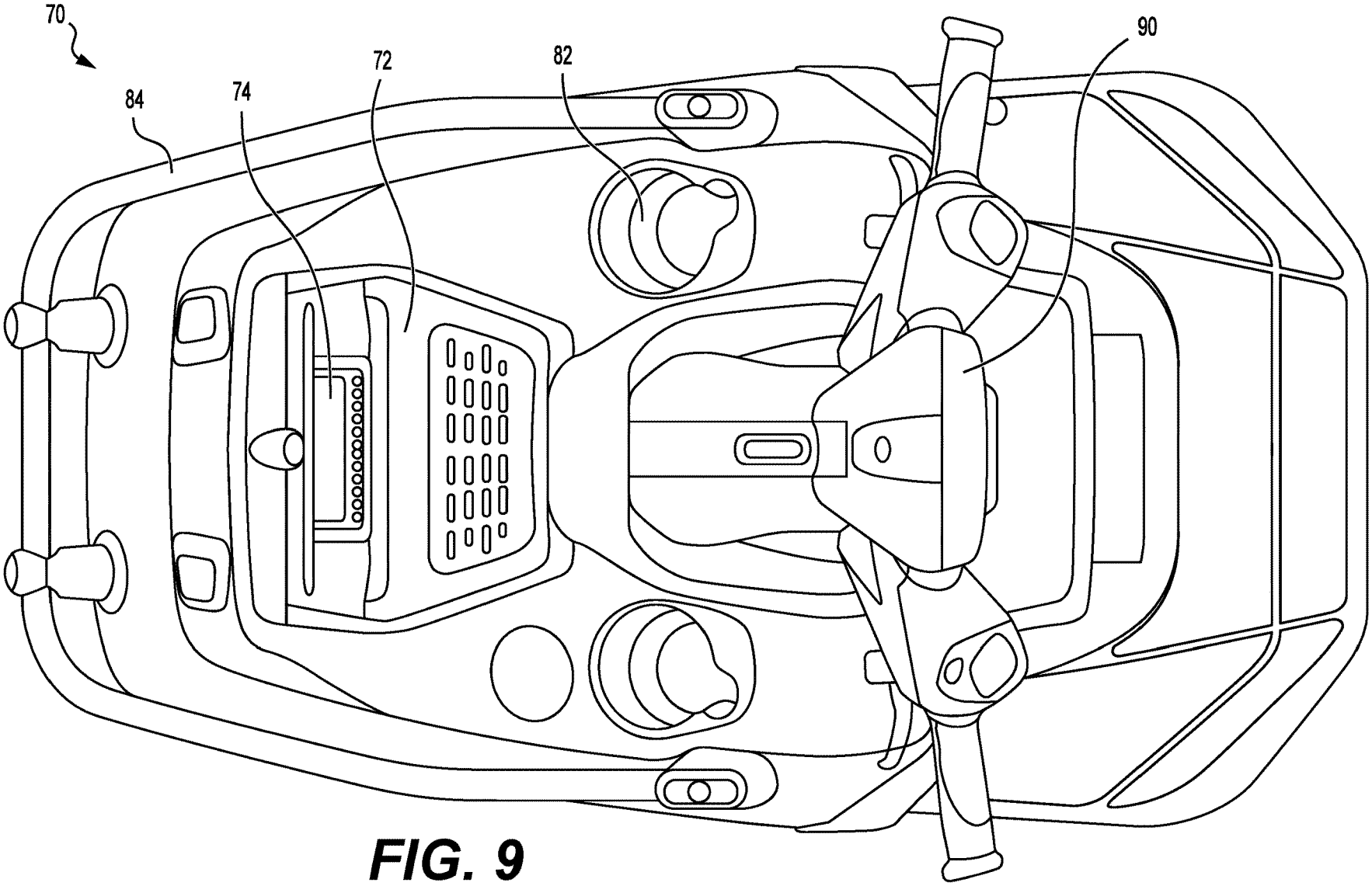
FIG. 9 is a top plan view of the command console of FIG. 5.

A bench 62, a driver seat 64 and a command console 70, all of which are mounted on the upper surface 24 of the deck 20, are shown in FIG. 5, with a close-up view of the command console 70 being shown in FIG. 6. Other views of the command console 70 and of the driver seat are provided in FIGS. 7 to 9. The driver seat 64 is positioned on the upper surface 24 of the deck 20 behind the console 70 for providing access to the console 70 by the driver while allowing a clear view toward a bow 66 of the boat 10.

The command console 70 is in the form of a pedestal and comprises a handlebar assembly 90, and a dashboard 72 with a display device 74 (also called a "gauge"). Other devices shown on the command console 70 include a engine cut-off switch 78, control buttons 80, cup holders 82, a handrail 84, and a storage 86, some of which may or may not be present in various embodiments. Some of these components may differ or may be omitted in some implementations of the command console 70. It is contemplated that the handlebar assembly 90 could be replaced by a steering wheel. It is also contemplated that the command console may have a different structure, possibly a simpler structure, than that shown in the various Figures, being for example and without limitation embodied as a control panel of a personal watercraft. The particular configuration of the command console 70 is not intended to limit the present disclosure.

Figure 10A:
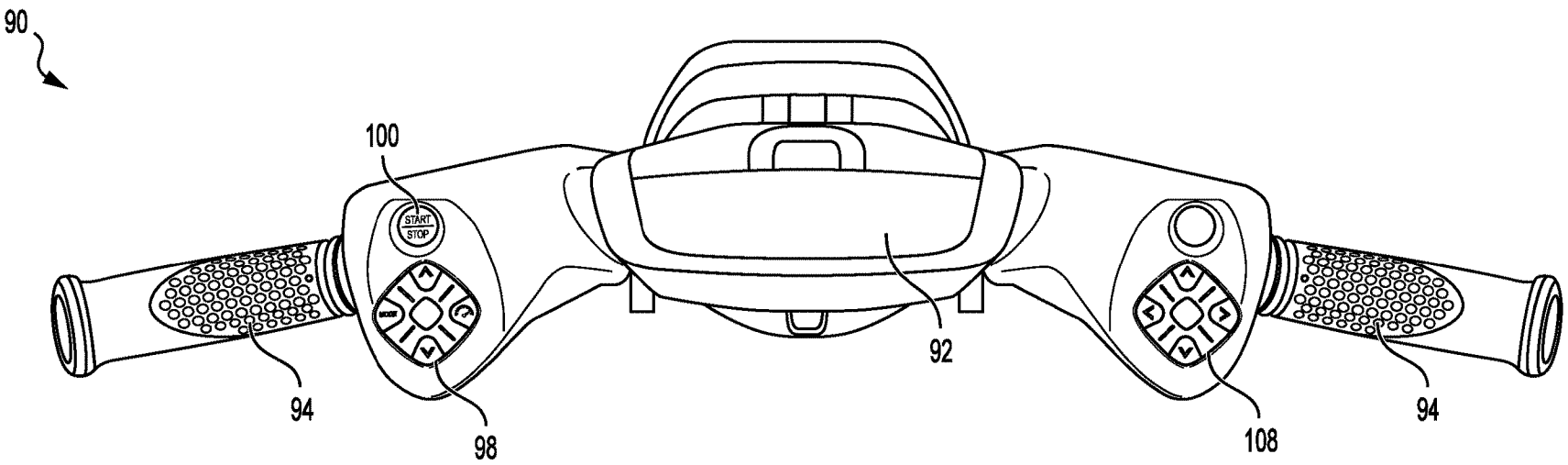
FIG. 10*a* is a top, rear perspective view of a handlebar assembly of the command console of FIG. 5.
Figure 10B:
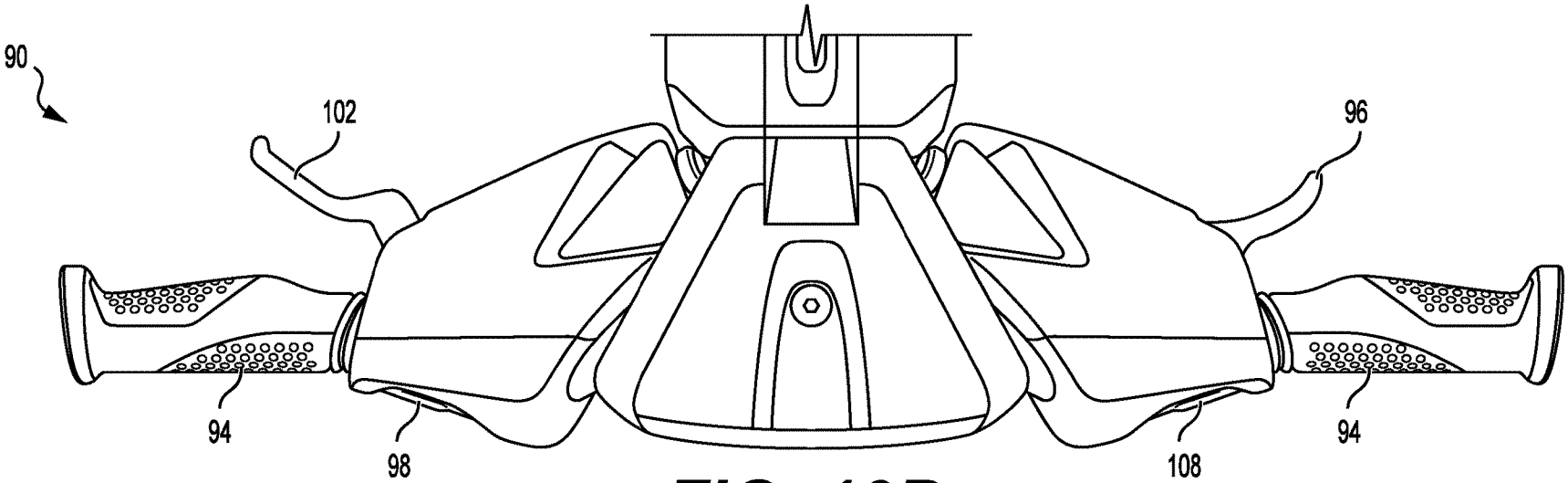
FIG. 10*b* is a top, front perspective, partial view of the handlebar assembly of FIG. 10*a;*

Steering, acceleration and braking functions of the boat 10 are controlled by use of the handlebar assembly 90 and of various controls mounted on the handlebar assembly 90. The handlebar assembly 90 is operatively connected to the steering nozzle 152 to steer the steering nozzle 152. An accelerator control lever 96, for example a throttle lever, is used to send commands for controlling operation of the jet propulsion system 52, including the motor 146. Details of the handlebar assembly 90 are shown in FIGS. 10*a* and 10*b*. The handlebar assembly 90 has a central handlebar portion 92, which may be padded, and a pair of handles 94. The right handle 94 is provided with the accelerator control lever 96, which is in the form of a finger-actuated accelerator control lever 96 in the present embodiment. The acceleration control lever 96 is pivotably attached on a forward side of the handlebar assembly 90, to the left of the right handle 94, and extends to the right in a position where it can be actuated by the fingers of the driver when his right hand is on the right handle 94. Other types of accelerator control operators, such as a thumb-actuated accelerator control lever and a twist grip, are also contemplated. The left handle 94 is provided with a multifunction control pad 98. A start/stop button 100, a deceleration and reverse control lever 102 are also present on the handlebar assembly 90. The start/stop button 100 is disposed on the handlebar assembly 90, to the right of the left handle 94. The deceleration and reverse control lever 102 is pivotably attached on the forward side of the handlebar assembly 90, to the right of the left handle 94, and extends to the left in a position where it can be actuated by the fingers of the driver when his left hand is on the left handle 94.

Figure 11:
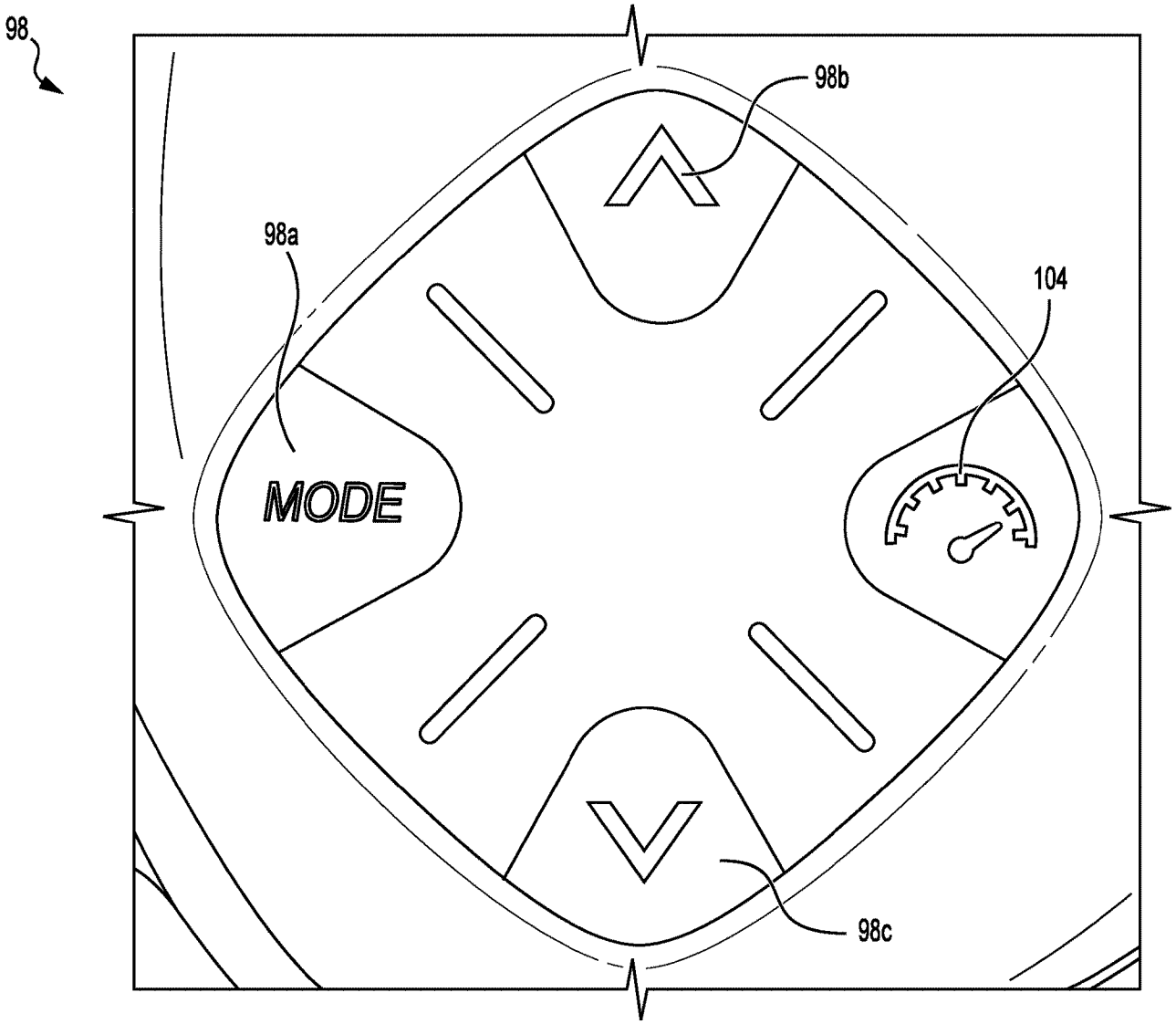
FIG. 11 is a close-up view of a cruise input pad mounted on the handlebar assembly of FIG. 10*a;*

Details of the multifunction control pad 98 are shown in FIG. 11. The multifunction control pad 98 has a mode button 98*a* that can be used by the driver of the boat 10 to select one of a plurality of driving modes, for example eco, sport, wake, ski, touring, and the like. Trim adjustment buttons 98*b* and 98*c* are respectively used to increase or decrease a trim of the boat 10, by way of trim control functions described hereinbelow. The start/stop button 100 starts the motor 146. A cruise control button 104 is actuated by the driver to engage the cruise control function in view of a set point defined according to current operating parameters (e.g. throttle opening, engine speed, and/or ICE torque, or the equivalent in the case of an electric motor) that are present in the boat 10 at the time. Depending on a particular operating parameter of the motor 146, the resulting cruising speed of the boat 10 may vary somewhat. For example, in an embodiment where an output torque of the motor 146 is controlled, a resulting speed of the boat 10 may not be vary according to other driving conditions, for example wind and/or current conditions.

The effects of actuating some of the buttons of the multifunction control pad 98 are described hereinbelow. It is contemplated that the multifunction control pad 98, or another suitable driver-controllable feature, may instead be located in any other convenient location within reach of the driver, such as on the right handle 94, on or next to the display device 74, or on any other part of the command console 70 within easy reach of the driver. Implementing the buttons 98*a*, 98*b*, 98*c* and 104 as discrete components on the handlebar assembly 90 or on any other part of the command console 70 is also contemplated.

Figure 12:
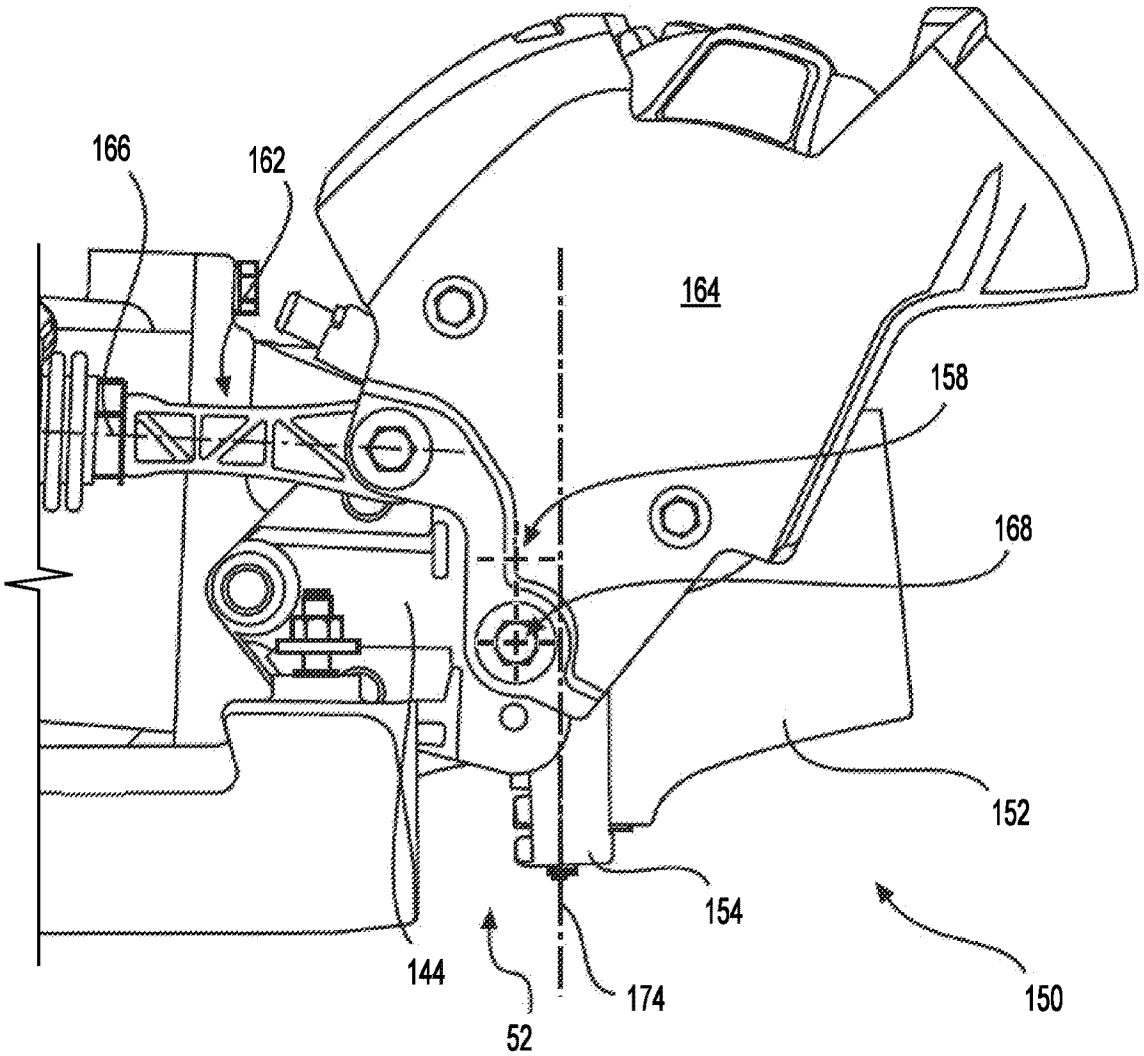
FIG. 12 is a left side, partial elevation view of some components of a variable trim and reverse gate system of the pontoon boat of FIG. 5.
Figure 13:
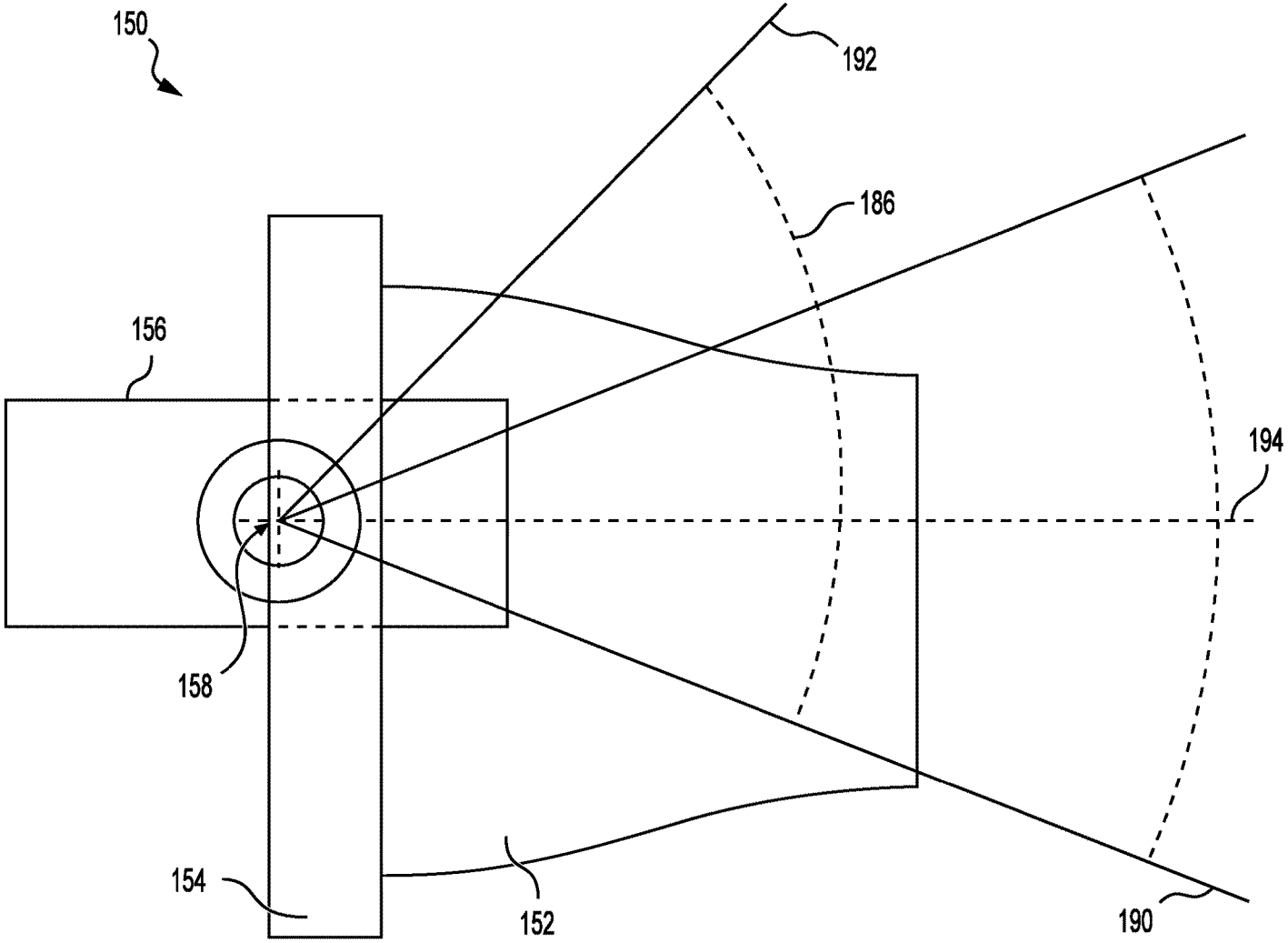
FIG. 13 is a schematic diagram showing operation of the variable trim system of FIG. 10.

The boat 10 is equipped with a variable trim system (VTS) 150 configured to direct a jet of water from the jet propulsion system 52 at a variable angle rearwardly from the boat 10, in view of adjusting a running angle of the boat 10 over water. An example of a VTS is described in U.S. Pat. No. 10,864,972, issued on Dec. 15, 2020, the disclosure of which is incorporated herein by reference in its entirety. In an embodiment of the boat 10, a jet pump driven by the motor 146 pressurizes water pumped from a body of water and expels it through a venturi as a jet directed rearwardly of the boat 10 to create thrust. As shown in FIGS. 12 and 13, the VTS 150 comprises the nozzle 152, a trim support 154 and a trim actuator 156. The nozzle 152 is pivotally connected to the trim support 154 about the steering axis 174, rearwardly of the venturi, and the trim support 154 is pivotally connected to side brackets 144 about a trim axis 158. The side brackets 144 maintain relative positions of the components of the VTS 150 and of the jet propulsion system 52. The steering axis 174 is perpendicular to the trim axis 158. The trim actuator 156 (schematically shown in FIG. 13) is operatively connected to the trim support 154 for pivoting the trim support 154 with the nozzle 152 about the trim axis 158. A push-pull cable connects the nozzle 152 to the handlebar assembly 90 for pivoting the nozzle 152 about the steering axis 174 in response to movements of the handlebar assembly 90. A jet of water expelled from a venturi (not shown) of the jet propulsion system 52 passes through the nozzle 152. The nozzle 152 redirects this jet of water left or right as it pivots about the steering axis 174 to steer the watercraft 10. The nozzle 152 redirects this jet of water up or down as it pivots about the trim axis 158 to trim the watercraft 10.

More specifically, the trim actuator 156 may be an electrical linear actuator 156, which includes an electrical actuator motor (not shown) and an actuator arm 162. The actuator arm 162 extends rearward to a reverse gate 164, which is movable between a fully stowed position where it does not interfere with a jet of water being expelled by the nozzle 152 and a plurality of positions where it redirects the jet of water being expelled by the nozzle 152. The reverse gate 164 is pivotally connected to the brackets 144 about a reverse gate axis 168 and may thus move between a range of forward positions and a range of reverse positions, as well as one or more neutral positions therebetween. The actuator motor imparts linear motion to the actuator arm 162 along an actuation axis 166 for pulling or pushing on the reverse gate 164. This causes the reverse gate 164 to pivot upward or downward about a reverse gate axis 168. Thus, in the present embodiment, the trim actuator 156 is also a reverse gate actuator that controls both the position of the reverse gate 164 and the trim angle of the nozzle 152.

The trim of the nozzle 152 is controlled by the driver via the trim adjustment buttons 98*b* and 98*c* of the multifunction pad 98. Energizing the trim actuator 156 causes rotation of the trim support 154 about the trim axis 158. The trim support 154, and therefore the nozzle 152, pivot upward or downward about the trim axis 158 when the reverse gate 164 pivots upward or downward about the reverse gate axis 168 as directed by the trim adjustment buttons 98*b* or 98*c*. When the reverse gate 164 is at its fully raised position, the nozzle 152 is at its maximum trim up angle 192 and the reverse gate 164 does not interfere with the jet of water expelled from the nozzle 152. From this position, as the trim actuator 156 causes the reverse gate 164 to pivot downward about the reverse gate axis 168, the nozzle 152 pivots downward about the trim axis 158 until the nozzle 152 reaches its maximum trim down angle 190. As the nozzle 152 pivots between the maximum trim up and trim down angles 192, 190, the reverse gate 164 does not interfere with the jet of water expelled from the nozzle 152. Once the nozzle 152 reaches the maximum trim down angle 190, continued extension of the actuator arm 162 continues the downward rotation of the reverse gate 164 and causes the reverse gate 164 to interfere with the jet of water expelled from the nozzle 152 redirecting first downward and eventually partly forward to decelerate the watercraft 10 or cause the watercraft 10 to move in reverse while the nozzle 152 stays at the maximum trim down angle 190. When the actuator 156 causes the reverse gate 164 to pivot upward about the reverse gate axis 168, the nozzle 152 remains at the maximum trim down angle 190 until the reverse gate 164 no longer interferes with the jet of water expelled from the nozzle 152, at which point the nozzle 152 pivots upward about the trim axis 158 as the reverse gate 164 continues to pivot upward about the reverse gate axis 168. Additional details regarding the mechanical components of the trim system 150 may be found in U.S. Pat. No. 9,376,189 B1, issued Jun. 28, 2016 the disclosure of which is incorporated herein by reference in its entirety. In this embodiment, a single actuator 156 is used to pivot of the nozzle 152 about the trim axis 158 and the reverse gate 164 about the reverse gate axis 168, but it is contemplated that, in some embodiments, the trim support 154 could be operatively connected to the trim actuator 156 independently of the reverse gate 164 and that the reverse gate 164 could be provided with its own separate actuator.

A range of trim angles 186 is defined between a maximum trim down angle 190 and a maximum trim up angle 192. The maximum trim down angle 190 and the maximum trim up angle 192 correspond to the maximum trim down and trim up angles at which the trim actuator 156 can position the nozzle 152. A neutral trim angle 194 (i.e. a trim angle of zero degree when the nozzle 152 and the venturi are coaxial) corresponds to a 35% trim position.

The propulsion system 52 of the boat 10 can be operated in forward, neutral and reverse operation modes. The boat 10 can generate a reverse thrust by lowering the reverse gate 164 to redirect the jet of water toward the front of the boat 10, thereby decelerating the boat 10 when if it is travelling at speed or propelling it in the reverse direction if it is at rest. By controlling the position of the reverse gate 164 and the amount of thrust generated by the jet propulsion system 52, the driver of the boat 10 can control the amount of reverse thrust being generated. When the boat 10 is being operated in forward operation mode and the driver actuates the deceleration and reverse control lever 102, the position of the reverse gate 164 and amount of thrust generated by the jet propulsion system 52 will be controlled so that the boat 10 decelerates. An example of such a brake and reverse system can be found in U.S. Pat. No. 9,908,601, issued on Mar. 6, 2018, the disclosure of which is incorporated herein by reference in its entirety.

A control system 200 (FIG. 14) for the boat 10 according to a non-limiting embodiment of the present technology comprises an engine control module (ECM) 210, a trim and reverse gate controller 220, and a user input module 230. The control system 200 is configured to control operations of the boat 10, in particular a cruising speed of the boat 10. The control system 200 controls operations of the boat 10 by sending commands to the ICE or electric motor (schematically shown in FIG. 14 as a motor 146) and to the trim actuator 156. If the motor 146 is an electric motor, the ECM 210 may more conventionally referred to as a motor control module (MCM). The term "ECM" will be used in the sequel in order to simplify the illustration.

The ECM 210 generally controls driving functions of the jet propulsion system 52 and of the motor 146, including speed or torque of the motor 146, as a function of driver inputs. The trim and reverse gate controller 220 controls the trim actuator 156 for positioning the reverse gate 164 and trim position of the nozzle 152 as a function of driver inputs for trim adjustment and under deceleration or reverse conditions, as well as based on a position of the deceleration and reverse control lever 102 and on a selection of forward or reverse operation of the boat 10. The trim and reverse gate controller 220 provides inputs to the ECM 210 for purposes of adjusting the thrust of the jet propulsion system 52 upon deceleration or emergency stop. The user input module 230 receives various driver inputs, provides these inputs to the ECM 210 or to the trim and reverse gate controller 220 as appropriate, and cause a display of corresponding statuses on the display device 74.

In an embodiment, each of the ECM 210, the trim and reverse gate controller 220 and the user input module 230 comprises a respective processor 250 (or a plurality of cooperating processors), a respective memory device 260 (or a plurality of cooperating memory devices), and a respective communication module 260. The communication modules may each comprise an input device and an output device, or an input/output device. The memory device 260 may comprise a non-transitory memory storing code instructions 262 for executing the functions assigned to the ECM 210, the trim and reverse gate controller 220 or the user input module 230. The memory device 260 may also comprise a storage for parameters used in executing the functions assigned to the ECM 210, the trim and reverse gate controller 220 or the user input module 230. In some embodiments, the ECM 210, the trim and reverse gate controller 220 and the user input module 230 may be combined in a single control unit 240. Any combination of two of the ECM 210, the trim and reverse gate controller 220 and the user input module 230 in a single controller operatively connected to a remaining one of the ECM 210, the trim and reverse gate controller 220 and the user input module 230 is also contemplated.

In the shown embodiment, the multifunction control pad 98 (which includes the cruise control button 104), a position sensor 96S of the accelerator control lever 96 and a position sensor 102S of the deceleration and reverse control lever 102 are both mounted to the command console 70 and communicatively connected to the user input module 230. These connections may be in electrical, electronical, and/or optical form, depending on the type of driver controls. In some embodiments, mechanical connections (e.g. cables) may be provided between the acceleration control lever 96 and/or the deceleration and reverse control lever 102 and the user input module 230. The user control module 230 receives the various commands from the multifunction control pad 98, the accelerator control lever position sensor 96S and the deceleration control lever position sensor 102S, and forwards these commands to the ECM 210 and/or to the trim and reverse gate controller 220, as appropriate. For example, signals from the accelerator control lever position sensor 96S, from the mode button 98*a*, and from the cruise control button 104 are directed to the ECM 210. Signals from the trim adjustment buttons 98*b* and 98*c*, and signals from the deceleration control lever position sensor 102S and from the emergency stop button 98*d* are directed to the trim and reverse gate controller 220. The trim and reverse gate controller 220 also provides signals to the ECM 210, for example for controlling the thrust of the jet propulsion system 52 when deceleration or emergency stop commands are received at the trim and reverse gate controller 220.

Various operations of a method for controlling a cruising speed of a watercraft, such as for example and without limitation the pontoon boat 10, are illustrated in FIGS. 16*a*-16*d*. Some of these operations of a sequence 300 may be present in some embodiments and not in other embodiments, being optional. Many of these operations are implemented in a control unit 240 that comprises the user ECM 210, the trim and reverse gate controller 220 and the input module 230. The control unit 240 may alternatively be implemented as a single unit combining the functions of the ECM 210, the trim and reverse gate controller 220 and the input module 230.

Figure 16A:
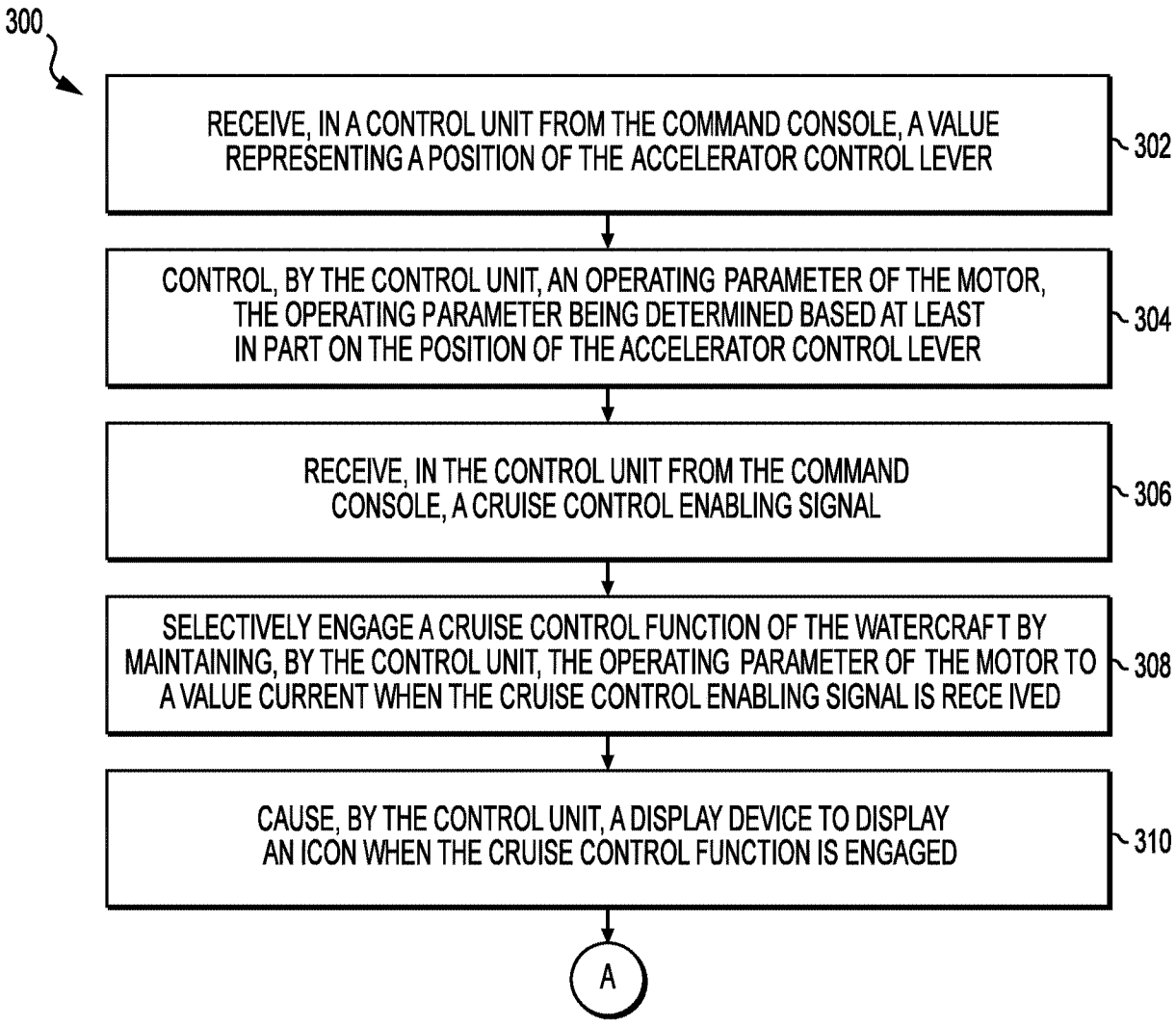
FIGS. 16*a*-16*d* collectively represent a sequence diagram showing operations of a method for controlling a cruising speed of the pontoon boat of FIG. 5.

In a part of the sequence 300 illustrated in FIG. 16*a*, the control unit 240 receives, at operation 302, from the command console 70 (for example from the position sensor 96S), a value representing a current position of the accelerator control lever 96. The control unit 240 controls an operating parameter of the motor 146 at operation 304, the operating parameter being determined based at least in part on the current position of the accelerator control lever 96. In various embodiments, the operating parameter of the motor may comprise a rotational speed of a component of the motor (for example the crankshaft of an ICE or the rotor of an electric motor), an output torque of the motor, a throttle opening in the case of an ICE, or a level of power or current being delivered in the case of an electric motor. One or more of these operating parameters of the motor, in any combination, may be controlled by the control unit 240.

Figure 17:
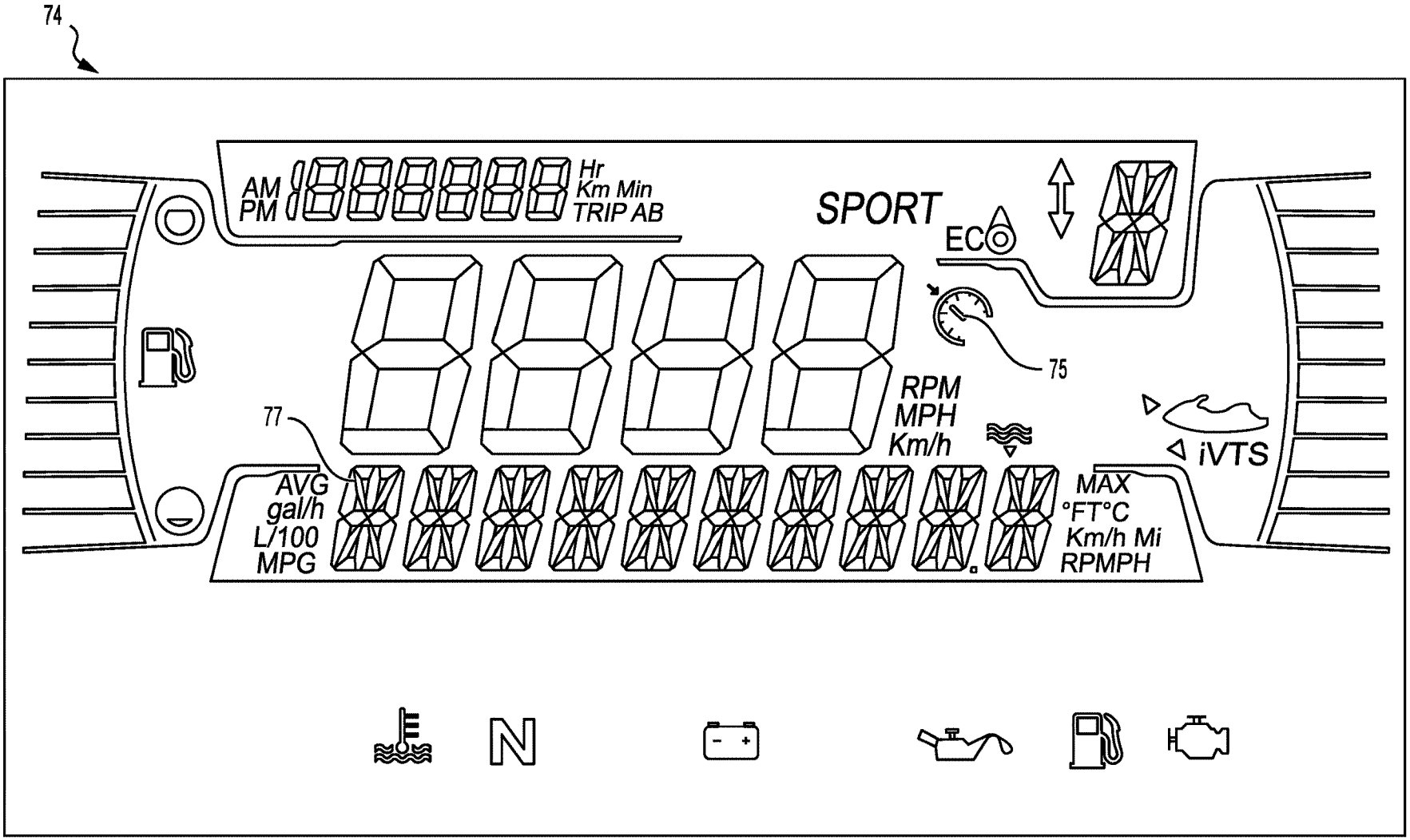
FIG. 17 is an illustration of a gauge screen of the command console of FIG. 7.

At operation 306, the control unit 240 receives, from the command console 70, a cruise control enabling signal that results from the driver having depressed the cruise control button 104. In response to receiving the cruise control enabling signal, the control unit 240 selectively engages a cruise control function of the boat 10, at operation 308, by maintaining, by the control unit 240, the operating parameter (or parameters) of the motor to a value current at a time when the cruise control enabling signal is received. The driver can then release the accelerator control lever 96 when the control unit 240 causes the display device 70 to display an icon 75 (FIG. 17) at operation 310.

The control unit 240 may perform various other verifications before engaging the cruise control function at operation 308. Engagement of the cruise control function may depend on one or more conditions being fulfilled, including for example and without limitation the reverse gate 164 being in the forward position before receiving the cruise control enabling signal at the control unit 240, the motor being running when receiving the cruise control enabling signal at the control unit 240, and/or the forward operation mode being engaged before receiving the cruise control enabling signal at the control unit 240. The control unit 240 causes the display device 74 to display an error message in response to any condition preventing the selective engagement of the cruise control function.

Figure 16B:
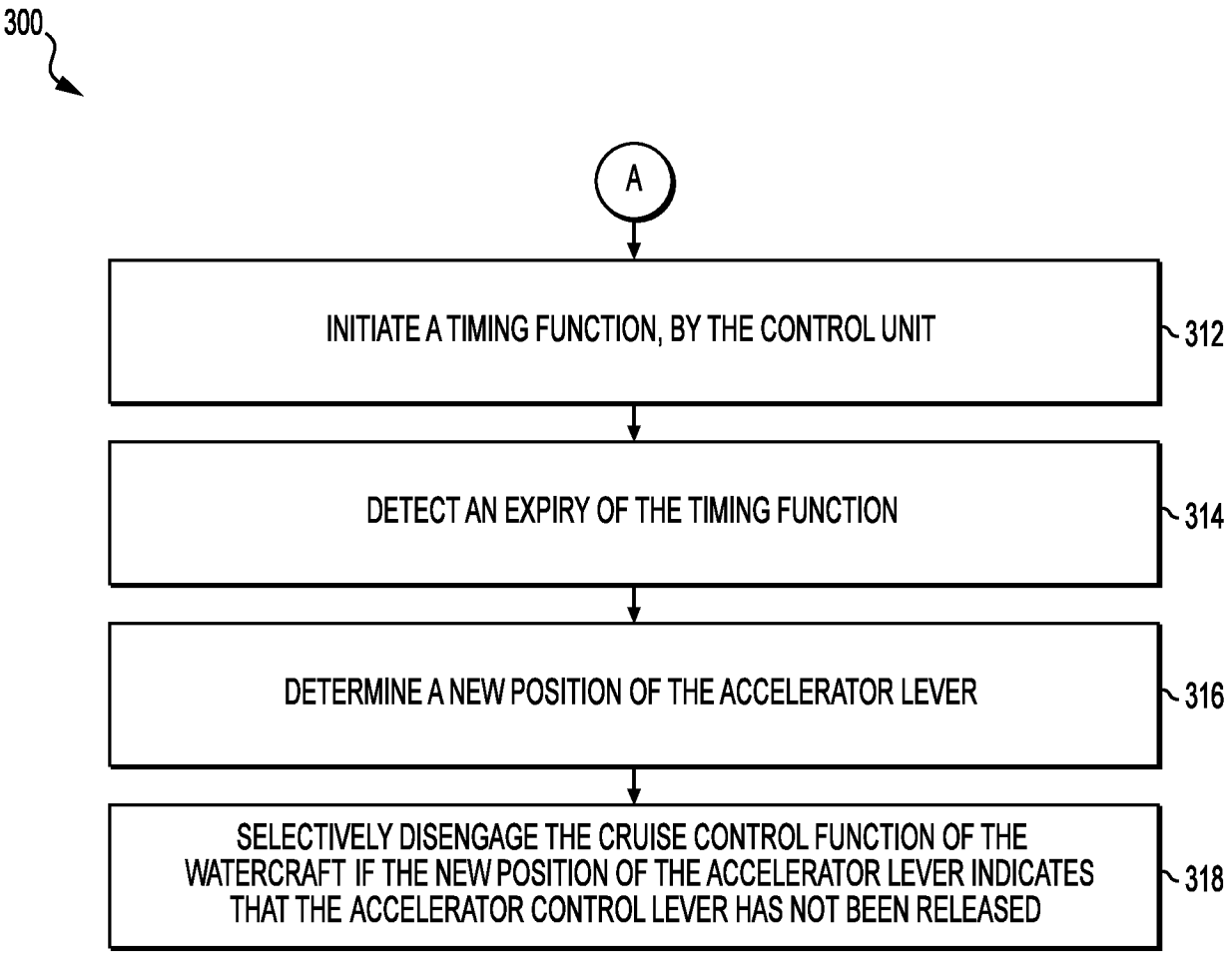

As shown on FIG. 16*b*, operations 312, 314, 316 and 318 optionally follow the selective engagement of the cruise control at operation 308. Concurrently with engaging the cruise control function, the control unit 240 initiates a timing function at operation 312. An expiry of the timing function is detected at operation 314, for example after a delay of 1 to 5 seconds. At operation 316, a new position of the accelerator control lever 96 is determined by the control unit 240, for example based on a signal received from the command console 70 (in particular from the position sensor 96S). Then at operation 318, the control unit 240 may selectively disengage the cruise control function of the boat 10 if the new position of the accelerator control lever 96 indicates that the accelerator control lever 96 has not been released.

Figure 16C:
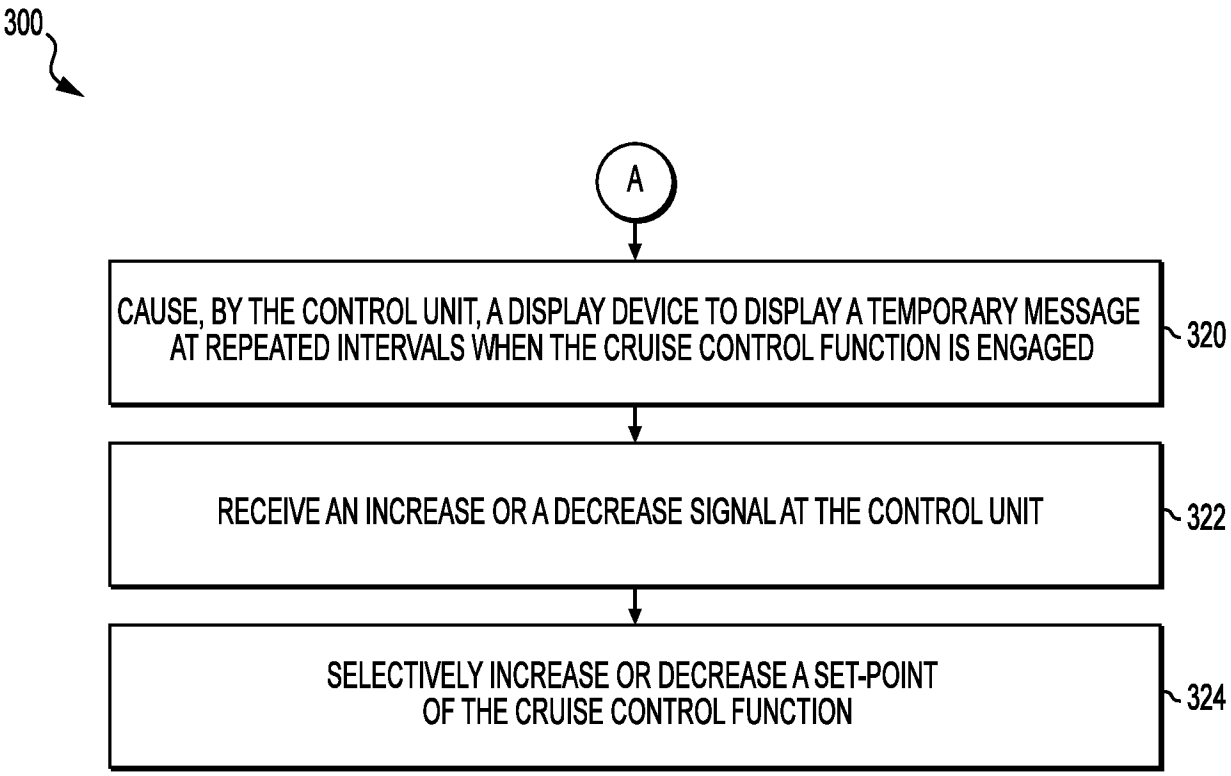
Figure 16D:
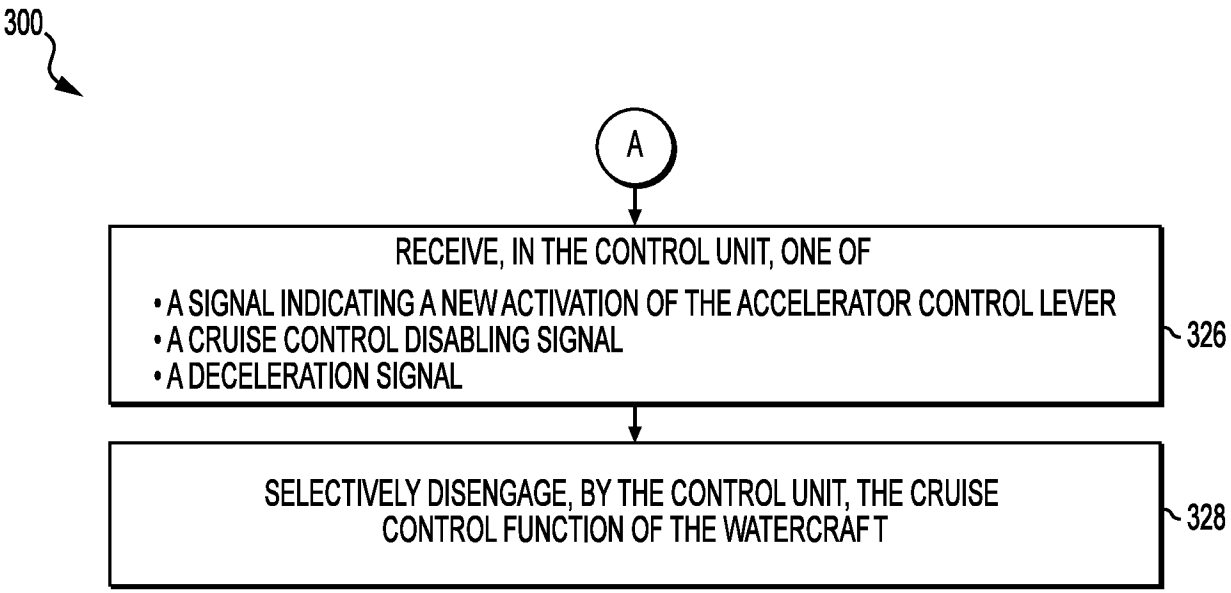

Other operations of the sequence 300 illustrated on FIGS. 16*c* and 16*d* may take place while the cruise control function is engaged, after operations 308 and 310. At operation 320, the control unit 240 causes the display device to display, in an alphanumeric display field 77, a temporary message at repeated intervals when the cruise control function is engaged. In an embodiment, the driver is allowed to modify the speed of the boat 10 while the cruise control function is engaged. To this end, the control unit 240 receives, from the command console, an increase or a decrease signal from the command console at the control unit 240 at operation 322. The increase or decrease signal may be provided in response to the driver actuating respective buttons on another multifunction control pad 108 provided on the right handle 94. In response to receiving the increase or decrease signal, the control unit 240 selectively increases or decreases, at operation 324, a set-point of the cruise control function.

The control unit 240 may receive, at operation 326, one or more signals from the command console 70, any one of these signals indicating that the driver intends to recover full control of the boat 10. These signals include an indication from the accelerator control lever sensor 96S that the activation of the accelerator control lever 96 is newly actuated (possibly above a predetermined deactivating threshold), a cruise control disabling signal received from the multifunction control pad 98, or a deceleration signal received from the deceleration control lever position sensor 102S. In response to any on of these signals, the control unit 240 selectively disengages the cruise control function of the boat 10 at operation 328.

When the cruise control function is disengaged at operation 328, the control unit 240 may cause ramping up or down the operating parameter of the motor between a first set-point effective before disengaging the cruise control function and a second set-point determined according to a position of the accelerator control lever 96 following the disengagement of the cruise control function. If the accelerator control lever 96 is not actuated after the disengagement of the cruise control function, the control unit 240 may cause to gradually decrease the operating parameter of the motor. For example, if the position of the accelerator control lever 96 at the moment the cruise control enabling signal was received by the control unit 240 indicated a 100% torque request, and if the accelerator control lever 96 is not actuated when the cruise control function is subsequently disengaged, the control unit 240 may gradually ramp down the torque request from 100% to 0% in order to prevent an abrupt deceleration of the boat 10. However, if the deceleration and reverse control lever 102 is used to disengage the cruise control function, indicating the driver's desire to brake and not simply disengage cruise control, the control unit 240 does not intervene to smooth out deceleration but controls the position of the reverse gate 164 and thrust generated by the jet propulsion system 52 as would it normally in response to activation of the deceleration and reverse control lever 102.

Figure 14:
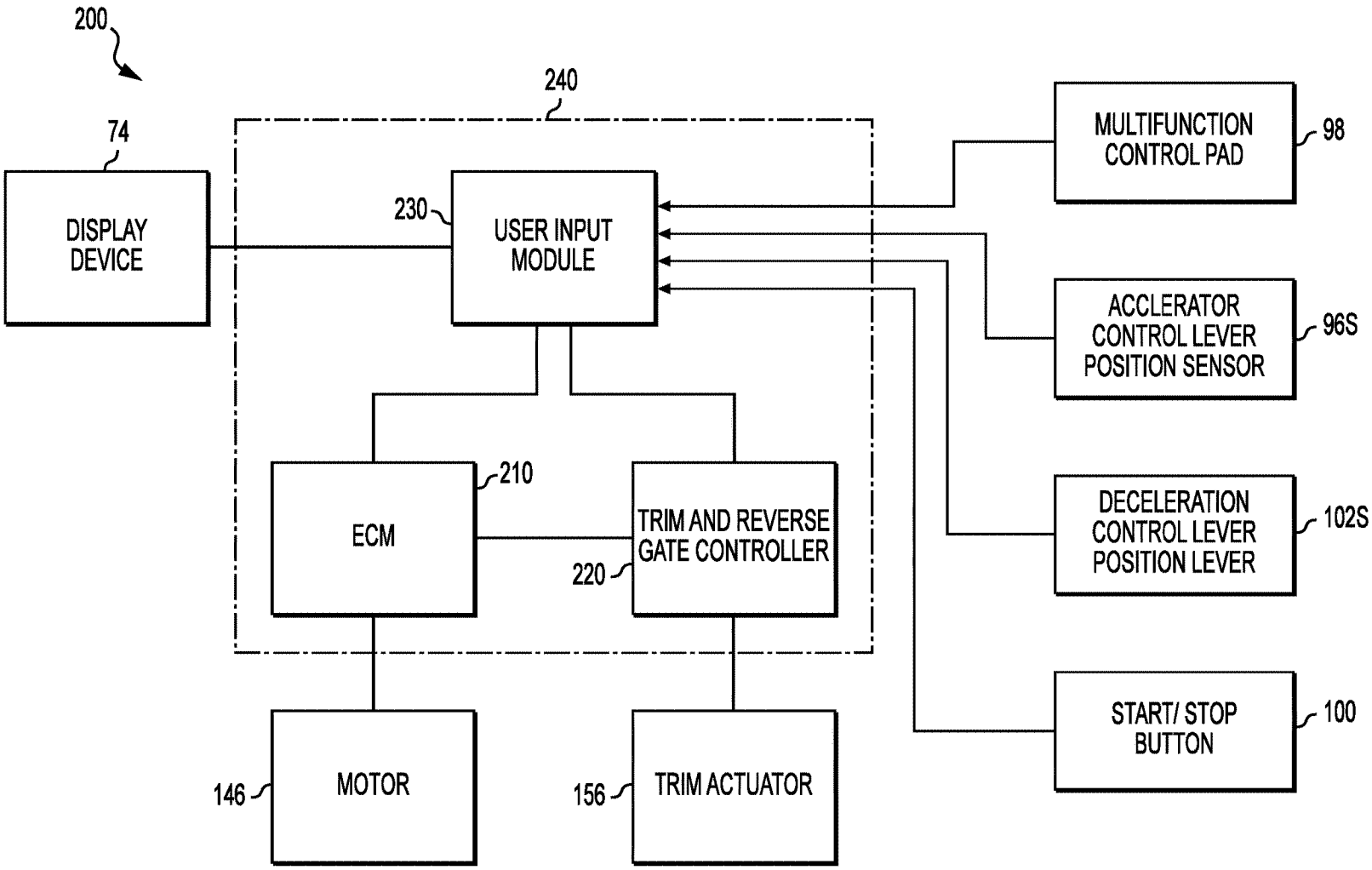
FIG. 14 is a block diagram of a control system for the pontoon boat of FIG. 5.
Figure 15:
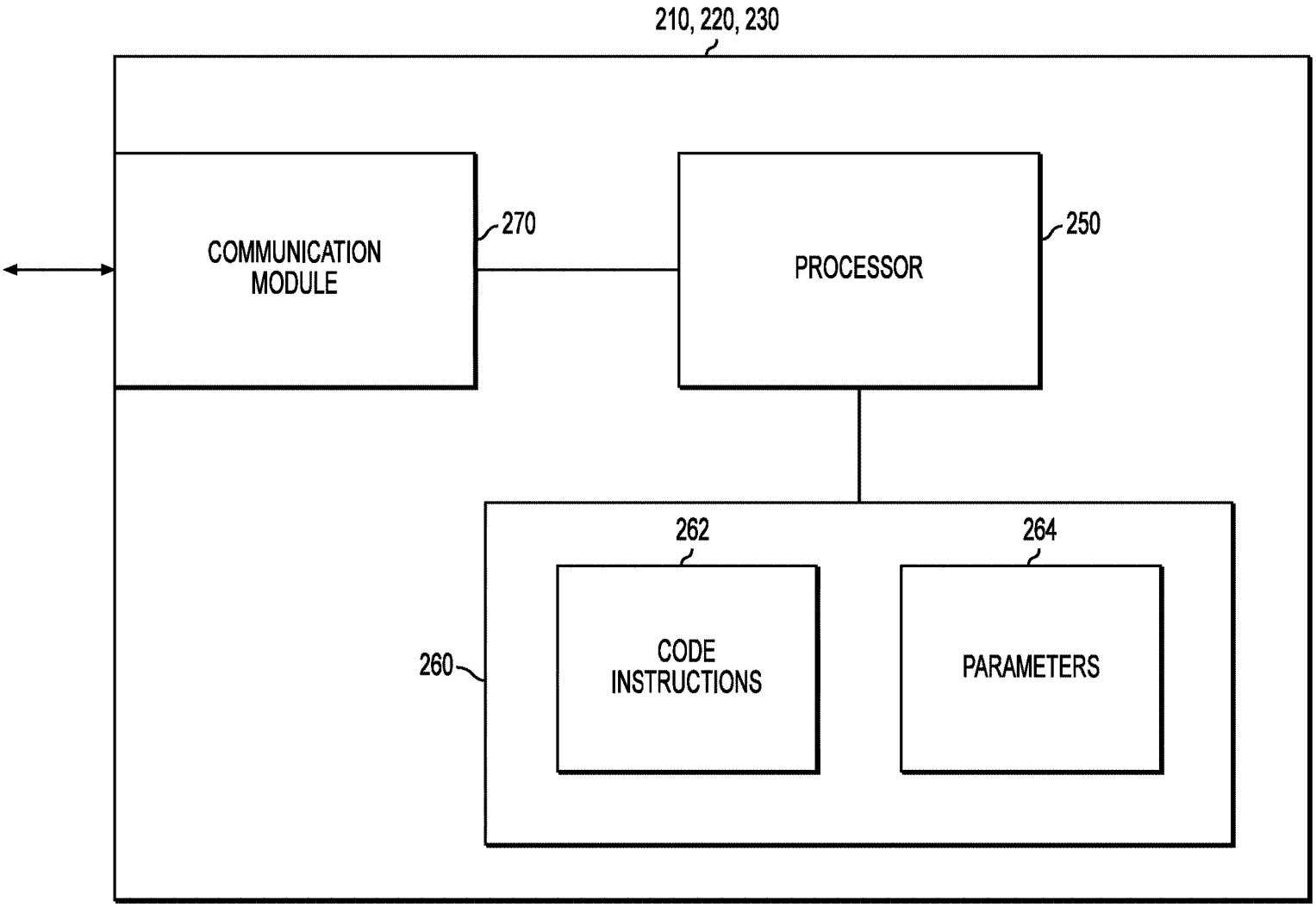
FIG. 15 is a block diagram of a control unit implementing one or more of a user input module, an engine control module and a trim brake and reverse controller.

In an embodiment, the control system 200 of FIG. 14 is configured to implement some or all of the functions of the various embodiments of the method for controlling the cruising speed of the boat 10 as described in relation to FIGS. 16*a*-16*d*. The operations of the method for controlling the cruising speed of the boat 10 may be assigned to the control unit 240 which includes one or more of the ECM 210, the trim and reverse gate controller 220, and the user input module 230, as appropriate in view of the nature of these modules.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A method for controlling a cruising speed of a watercraft, the watercraft having a hull, a deck disposed on the hull, a motor connected to at least one of the hull and the deck, a propulsion system operatively connected to the motor, a command console disposed on the deck and operatively connected to the motor, and an accelerator control lever operatively connected to the command console, the accelerator control lever being biased toward an idle position, the method comprising:

receiving, in a control unit from the command console, a value representing a position of the accelerator control lever;

controlling, by the control unit, an operating parameter of the motor, the operating parameter being determined based at least in part on the position of the accelerator control lever;

receiving, in the control unit, a cruise control enabling signal from the command console;

in response to receiving the cruise control enabling signal, selectively engaging a cruise control function of the watercraft by maintaining, by the control unit, the operating parameter of the motor to a value current when the cruise control enabling signal is received;

receiving, in the control unit, a signal indicating a new activation of the accelerator control lever; and in response to receiving the signal indicating the new activation of the accelerator control lever while the cruise control function is engaged, selectively disengaging, by the control unit, the cruise control function of the watercraft.

2. A method for controlling a cruising speed of a watercraft, the watercraft having a hull, a deck disposed on the hull, a motor connected to at least one of the hull and the deck, a propulsion system operatively connected to the motor, a command console disposed on the deck and operatively connected to the motor, and an accelerator control lever operatively connected to the command console, the accelerator control lever being biased toward an idle position, the method comprising:

receiving, in a control unit from the command console, a value representing a position of the accelerator control lever;

controlling, by the control unit, an operating parameter of the motor, the operating parameter being determined based at least in part on the position of the accelerator control lever;

receiving, in the control unit, a cruise control enabling signal from the command console;

in response to receiving the cruise control enabling signal, selectively engaging a cruise control function of the watercraft by maintaining, by the control unit, the operating parameter of the motor to a value current when the cruise control enabling signal is received;

initiating a timing function, by the control unit, in response to receiving the cruise control enabling signal;

detecting an expiry of the timing function;

in response to detecting the expiry of the timing function, determining a new position of the accelerator control lever; and in response to the new position of the accelerator control lever indicating that the accelerator control lever has not been released, selectively disengaging the cruise control function of the watercraft.

3. The method of claim 1, wherein the propulsion system is a jet propulsion system.

4. The method of claim 3, wherein:

the jet propulsion system comprises a reverse gate having a forward position and a reverse position; and engaging the cruise control function of the watercraft is conditional to the reverse gate being in the forward position before receiving the cruise control enabling signal at the control unit.

5. The method of claim 3, wherein:

the jet propulsion system comprises a reverse gate having a range of forward positions and a range of reverse positions;

the reverse gate, the motor and the control unit implement a braking function configured for placing the reverse gate in a reverse position and for increasing a thrust generated by the propulsion system in response to receiving, in the control unit, a signal activating the braking function; and the method further comprises disengaging the cruise control function of the watercraft in response to receiving, in the control unit, the signal activating the braking function.

6. The method of claim 1, wherein:

the watercraft further comprises a forward operation mode and a reverse operation mode; and engaging the cruise control function of the watercraft is conditional to the forward operation mode being engaged when receiving the cruise control enabling signal at the control unit.

7. The method of claim 1, wherein the command console comprises a handlebar assembly, the accelerator control lever being mounted to the handlebar assembly.

8. The method of claim 7, wherein the accelerator control lever is a finger-actuated control lever.

9. The method of claim 7, wherein the cruise control enabling signal is generated by actuating a cruise control button mounted on the handlebar assembly.

10. The method of claim 1, further comprising causing, by the control unit, a display device to display a temporary message at repeated intervals when the cruise control function is engaged.

11. The method of claim 1, wherein the watercraft is a pontoon.

12. The method of claim 1, further comprising disengaging the cruise control function of the watercraft in response to receiving, in the control unit, an indication that that the accelerator control lever is at a position that exceeds a deactivating threshold.

13. The method of claim 12, further comprising ramping up or down the operating parameter of the motor between a first set-point effective before disengaging the cruise control function and a second set-point determined according to a position of the accelerator control lever following the disengagement of the cruise control function.

14. The method of claim 1, further comprising:

receiving, in the control unit, a cruise control disabling signal; and in response to receiving the cruise control disabling signal, gradually decreasing the operating parameter of the motor.

15. The method of claim 2, wherein the timing function expires 1 to 5 seconds after being initiated.

16. The method of claim 1, wherein the operating parameter of the motor is a rotational speed of a component of the motor.

17. The method of claim 1, wherein the operating parameter of the motor is an output torque of the motor.

18. The method of claim 1, wherein:

the motor is an internal combustion engine; and the operating parameter of the motor is a throttle opening of the internal combustion engine.

19. A watercraft, comprising:

a hull;

a deck disposed on the hull;

a motor connected to at least one of the hull and the deck;

a propulsion system operatively connected to the motor;

a command console disposed on the deck and operatively connected to the motor;

an accelerator control lever operatively connected to the command console, the accelerator control lever being biased toward an idle position;

a control unit operatively connected to the command console and to the motor, the control unit being configured to:

receive, from the command console, a value representing a position of the accelerator control lever;

control an operating parameter of the motor, the operating parameter being determined based at least in part on the position of the accelerator control lever;

receive, from the command console, a cruise control enabling signal;

in response to receiving the cruise control enabling signal, selectively engage a cruise control function of the watercraft by maintaining the operating parameter of the motor to a value current when the cruise control enabling signal is received;

receive a signal indicating a new activation of the accelerator control lever; and in response to receiving the signal indicating the new activation of the accelerator control lever while the cruise control function is engaged, selectively disengage the cruise control function of the watercraft.

20. A watercraft, comprising:

a hull;

a deck disposed on the hull;

a motor connected to at least one of the hull and the deck;

a propulsion system operatively connected to the motor;

a command console disposed on the deck and operatively connected to the motor;

an accelerator control lever operatively connected to the command console, the accelerator control lever being biased toward an idle position;

a control unit operatively connected to the command console and to the motor, the control unit being configured to:

receive, from the command console, a value representing a position of the accelerator control lever;

control an operating parameter of the motor, the operating parameter being determined based at least in part on the position of the accelerator control lever;

receive, from the command console, a cruise control enabling signal;

in response to receiving the cruise control enabling signal, selectively engage a cruise control function of the watercraft by maintaining the operating parameter of the motor to a value current when the cruise control enabling signal is received;

initiate a timing function in response to receiving the cruise control enabling signal;

detect an expiry of the timing function;

in response to detecting the expiry of the timing function, determining a new position of the accelerator control lever; and in response to the new position of the accelerator control lever indicating that the accelerator control lever has not been released, selectively disengage the cruise control function of the watercraft.

* * * * *